US011952743B2

(12) United States Patent
Kennedy

(10) Patent No.: US 11,952,743 B2
(45) Date of Patent: Apr. 9, 2024

(54) LOADER WITH MOVING APPARATUS

(71) Applicant: DEERE & COMPANY, Moline, IL (US)

(72) Inventor: Thomas L. Kennedy, Bettendorf, IA (US)

(73) Assignee: DEERE & COMPANY, Moline, IL (US)

( * ) Notice: Subject to any disclaimer, the term of this patent is extended or adjusted under 35 U.S.C. 154(b) by 50 days.

(21) Appl. No.: 17/451,024

(22) Filed: Oct. 15, 2021

(65) Prior Publication Data

US 2023/0123672 A1 Apr. 20, 2023

(51) Int. Cl.
*E02F 3/627* (2006.01)
*E02F 3/96* (2006.01)

(52) U.S. Cl.
CPC ..... *E02F 3/6273* (2013.01); *E02F 3/968* (2013.01)

(58) Field of Classification Search
None
See application file for complete search history.

(56) References Cited

U.S. PATENT DOCUMENTS 3,158,881 A * 12/1964 Clausen ..... B63C 13/00 114/344
3,337,890 A * 8/1967 Schmidt, Jr. ..... E01H 1/047 15/83
3,460,690 A 8/1969 Seifert
4,266,796 A * 5/1981 Riggs ..... B62D 53/0857 280/43.24
4,798,511 A 1/1989 Kaczmarczyk et al.
5,388,950 A 2/1995 Schmahl et al.
7,168,907 B2 1/2007 Lyons et al.
7,824,144 B2 * 11/2010 Wilson ..... B62B 5/0003 280/47.15
7,887,281 B2 * 2/2011 Haney ..... A61G 3/00 414/921
8,162,586 B2 4/2012 Webb et al.
8,684,656 B2 4/2014 Hilsden et al.
8,998,256 B2 4/2015 Faivre
9,267,263 B2 2/2016 Bertrand et al.
9,333,823 B2 * 5/2016 Shahroodi ..... B60B 33/0028
9,587,370 B2 3/2017 Lanting et al.
9,650,754 B2 5/2017 Martinez et al.
10,119,242 B1 11/2018 Faivre et al.
10,550,541 B1 2/2020 Diaz et al.
10,570,581 B2 2/2020 Faivre et al.
11,015,318 B2 5/2021 Rupp et al.
(Continued)

OTHER PUBLICATIONS

CA2730146 by Lu all pages. Published Dec. 9, 2010. (Year: 2101).*
(Continued)

*Primary Examiner* — Michael S Lowe

(57) ABSTRACT

A loader for a work vehicle includes a loader arm, a mast section rotatably connected to the loader arm, an implement removably attached to the loader arm, a first actuator connected between the loader arm and the mast, a second actuator connected between the loader arm and the implement, and a first roller apparatus having a use position and a storage position. The first roller apparatus is positioned nearer a ground surface in the use position than in the storage position. The first roller apparatus is in contact with the ground surface in the use position and spaced apart from the ground surface in the storage position.

19 Claims, 22 Drawing Sheets

(56) References Cited

U.S. PATENT DOCUMENTS

| | | | | |
|---|---|---|---|---|
| 2003/0182748 | A1 | 10/2003 | Watts | |
| 2019/0368156 | A1* | 12/2019 | Faivre | E02F 3/3695 |
| 2020/0347568 | A1 | 11/2020 | Faivre | |

OTHER PUBLICATIONS

Front End Loader Dolly Kubota BX Series, retrieved from the Internet <URL: https://www.bxpanded.com/BX-FEL-dolly>, 4 pages.
Backhoe Storage Dolly for BT603, BT602, BT601, BT600 Back Hoes, retrieved from the Internet <URL: https://www.bxpanded.com/BX-bh-dolly>, 4 pages.
John Deere 1025R Loader removal/storage on rollers/caster wheels, dated Mar. 28, 2016, Youtube Video, retrieved from the Internet <URL: https://www.youtube.com/watch?app=desktop&v=r76e3SgQ8FI>, 1 page.

* cited by examiner

LOADER WITH MOVING APPARATUS

CROSS-REFERENCE TO RELATED APPLICATIONS

N/A

FIELD OF THE DISCLOSURE

The present disclosure relates to moving apparatus for a loader of a work vehicle.

BACKGROUND

Work vehicles can include a front loader for a variety of tasks. The front loader can be attached to the work vehicle for use in moving material and then detached from the work vehicle when the task is complete. The loader may need to be relocated when detached from the work vehicle.

SUMMARY

This summary is provided to introduce a selection of concepts that are further described below in the detailed description and accompanying drawings. This summary is not intended to identify key or essential features of the appended claims, nor is it intended to be used as an aid in determining the scope of the appended claims.

The present disclosure includes moving apparatus for a loader of a work vehicle to reposition or relocate the loader when detached from the work vehicle. The moving apparatus can include one or more roller apparatus. The moving apparatus can include a connector.

According to an aspect of the present disclosure, a loader for a work vehicle includes a loader arm, a mast section rotatably connected to the loader arm, an implement removably attached to the loader arm, a first actuator connected between the loader arm and the mast, a second actuator connected between the loader arm and the implement, and a first roller apparatus having a use position and a storage position. The first roller apparatus is positioned nearer a ground surface in the use position than in the storage position. The first roller apparatus is in contact with the ground surface in the use position and spaced apart from the ground surface in the storage position.

The first roller apparatus can be fixedly, removably, or rotatably attached to the loader. The first roller apparatus can be positioned near a ground surface in a use position. The first roller apparatus can be positioned near the implement in a use position. The first roller apparatus can be positioned away from or spaced apart from the ground surface in the storage position. The first roller apparatus can be positioned away from the implement in the storage position. The first roller apparatus can be positioned near the implement, on the loader arm, or on the mast in the storage position. The loader can include a parking stand having a storage condition and a parking condition. The loader can include a second roller apparatus positioned on the parking stand. The second roller apparatus is in a use position when the parking stand is in the parking condition. The second roller apparatus is in a storage position when the parking stand is in the storage condition. The loader can include an attachment bracket mounted between the implement and the loader arm. The first roller apparatus can be removable attached to the attachment bracket, and the second roller apparatus can be fixedly attached to the parking stand. The first roller can include a brake. The loader can include a ground engaging lock. A connector can be attached to the loader. The connector can have a use position and a storage position.

According to an aspect of the present disclosure, a loader for a work vehicle includes a loader arm, a mast section rotatably connected to the loader arm, an attachment bracket attached to the loader arm, an implement removably attached to the attachment bracket, a first actuator connected between the loader arm and the mast, a second actuator connected between the loader arm and the implement, a parking stand having a storage condition and a parking condition, a first roller apparatus having a use position and a storage position, and a second roller apparatus attached to the parking stand. The first roller apparatus is positioned nearer a ground surface in the use position than in the storage position. The first roller apparatus is in contact with the ground surface in the use position and spaced apart from the ground surface in the storage position. The second roller is in contact with the ground surface when the parking stand is in the parking condition. The second roller spaced apart from the ground surface when the parking stand is in the storage condition.

The first roller apparatus can be removably or rotatably attached to the loader. The first roller apparatus can be positioned near the implement in a use position. The first roller apparatus can be positioned away from the implement in the storage position. The first roller apparatus can be positioned near the implement, on the loader arm, or on the mast in the storage position. The second roller apparatus can be fixedly attached to the parking stand. A connector can be attached to the loader. The connector can have a use position and a storage position.

These and other features will become apparent from the following detailed description and accompanying drawings, wherein various features are shown and described by way of illustration. The present disclosure is capable of other and different configurations and its several details are capable of modification in various other respects, all without departing from the scope of the present disclosure. Accordingly, the detailed description and accompanying drawings are to be regarded as illustrative in nature and not as restrictive or limiting.

BRIEF DESCRIPTION OF THE DRAWINGS

The detailed description of the drawings refers to the accompanying figures in which.

Like reference numerals are used to indicate like elements throughout the several figures.

DETAILED DESCRIPTION

Figure 1:
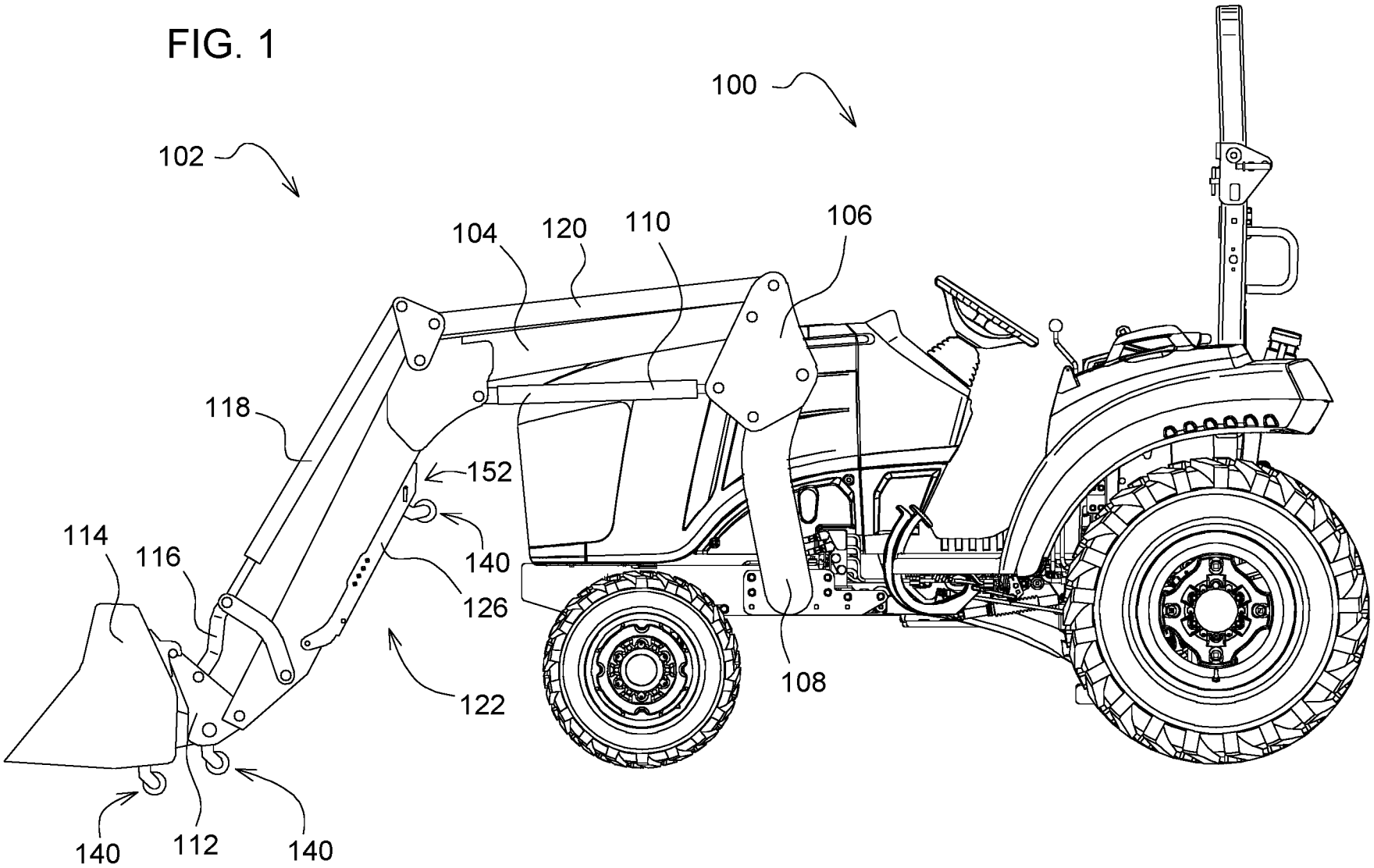
FIG. 1 is a perspective view of a work vehicle including a loader, according to an implementation.

The implementations disclosed in the above drawings and the following detailed description are not intended to be exhaustive or to limit the present disclosure to these implementations. Rather, there are several variations and modifications which may be made without departing from the scope of the present disclosure.

Those having ordinary skill in the art will recognize that terms such as "above," "below," "upward," "downward," "top," "bottom," etc., are used descriptively for the figures, and do not represent limitations on the scope of the present disclosure, as defined by the appended claims. Furthermore, the teachings may be described herein in terms of functional and/or logical block components and/or various processing steps, which may be comprised of any number of hardware, software, and/or firmware components configured to perform the specified functions.

Terms of degree, such as "generally," "substantially," or "approximately" are understood by those having ordinary skill in the art to refer to reasonable ranges outside of a given value or orientation, for example, general tolerances or positional relationships associated with manufacturing, assembly, and use of the described implementations.

FIGS. 1-5 illustrate a loader 102 that can be attached to a work vehicle 100, such as a tractor. The present disclosure also applies to other types of work vehicles in agriculture, utility, turf or lawn care, construction, forestry, and road building. The loader 102 includes loader arms 104, which are attached to the work vehicle 100 by a mast section 106 and a bracket 108 mounted on the work vehicle 100. A first actuator 110 (e.g., a first hydraulic cylinder assembly) is connected to the loader arm 104 and the mast section 106 to raise and lower the loader arm 104. An attachment bracket 112, which is equipped with an interchangeable implement 114 (e.g., a bucket) is arranged at a distal end of the loader arm 104. The attachment bracket 112, and the implement 114, can be pivoted relative to the loader arm 104 by a second actuator 118 (e.g., a second hydraulic cylinder assembly). The loader 102 can include a linkage 116 connected between the attachment bracket 112 and the second actuator 118. The loader can include a linkage 120 used for parallel guidance of the attachment bracket 112, the implement 114, or both while the loader arm 104 is being raised and lowered. The loader 102 includes a lowered position and one or more raised positions. The loader 102 can be attached or detached to the work vehicle 100 in the lowered position.

Figure 2:
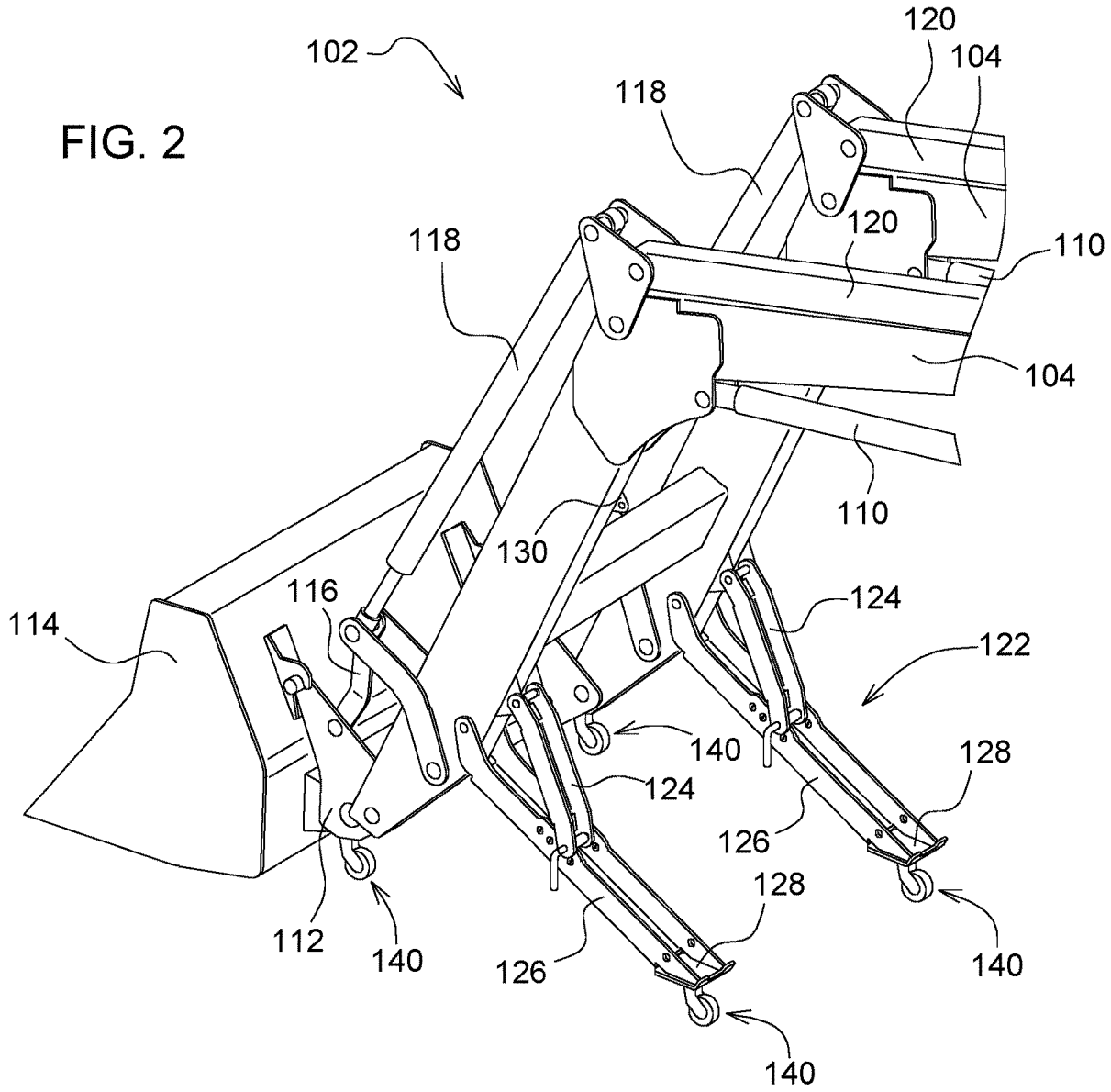
FIG. 2 is a perspective view of a loader for a work vehicle, according to an implementation.
Figure 3:
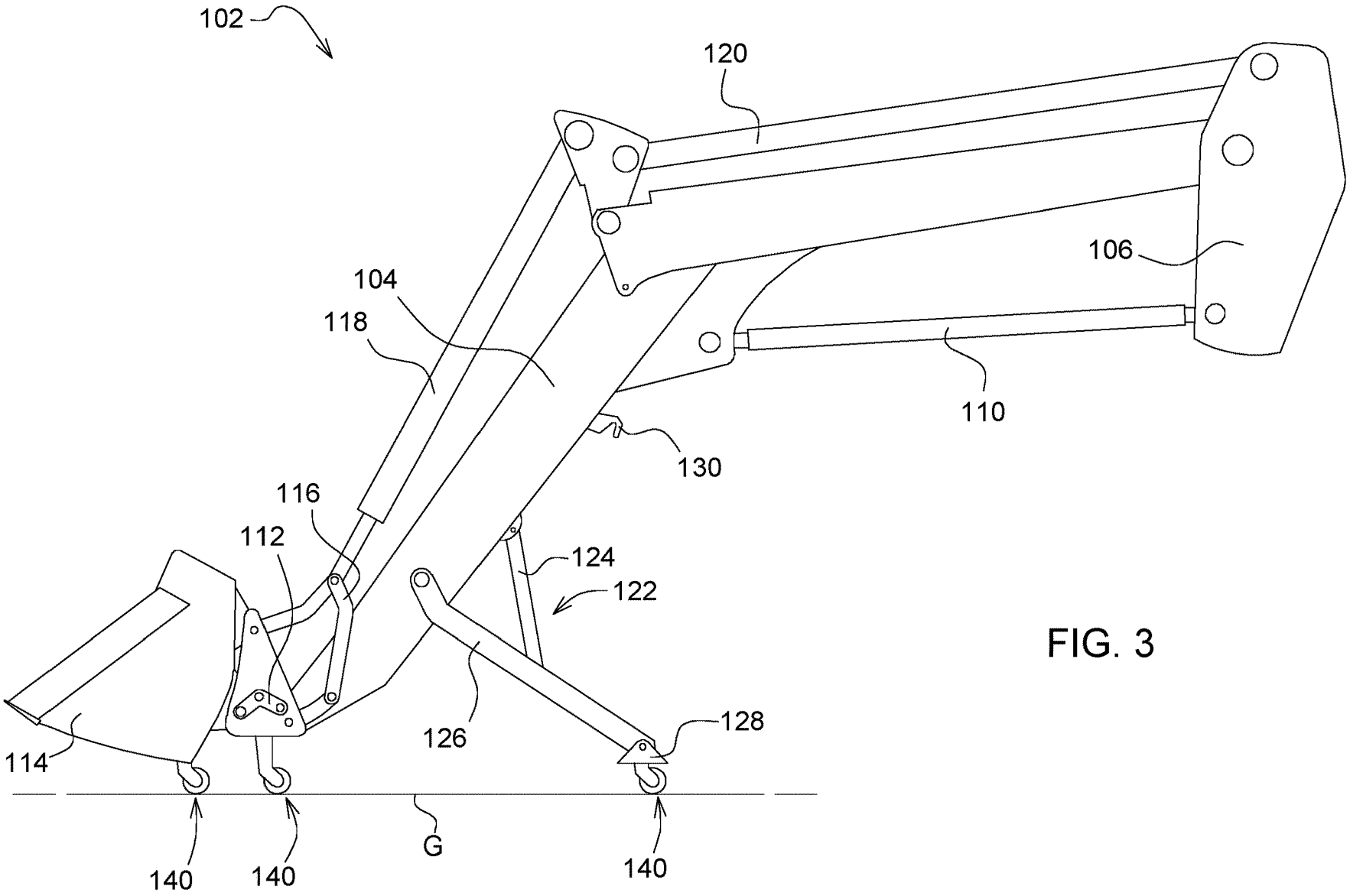
FIG. 3 is a perspective view of a loader for a work vehicle, according to an implementation.
Figure 4:
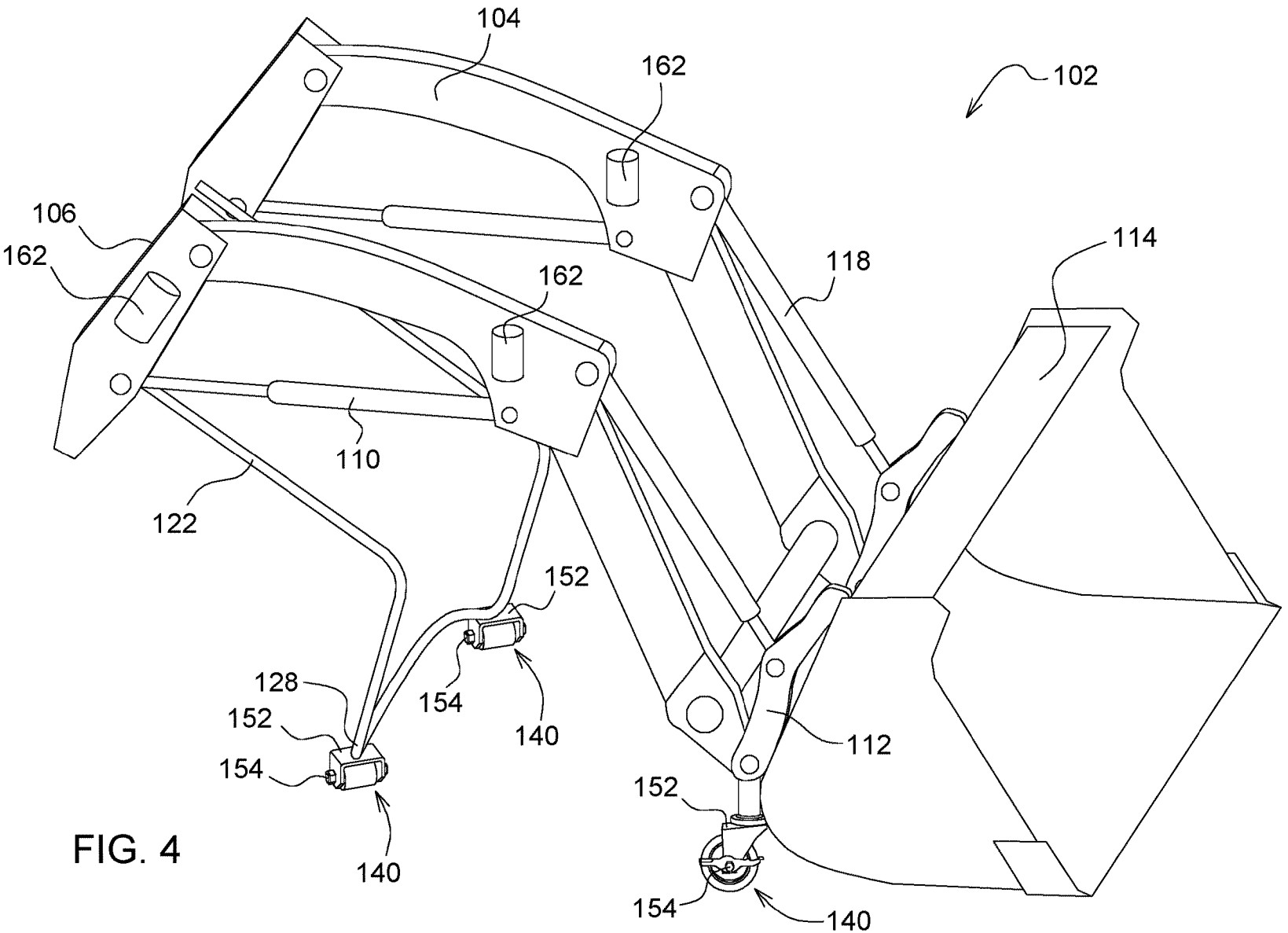
FIG. 4 is a perspective view of a loader for a work vehicle, according to an implementation.
Figure 5:
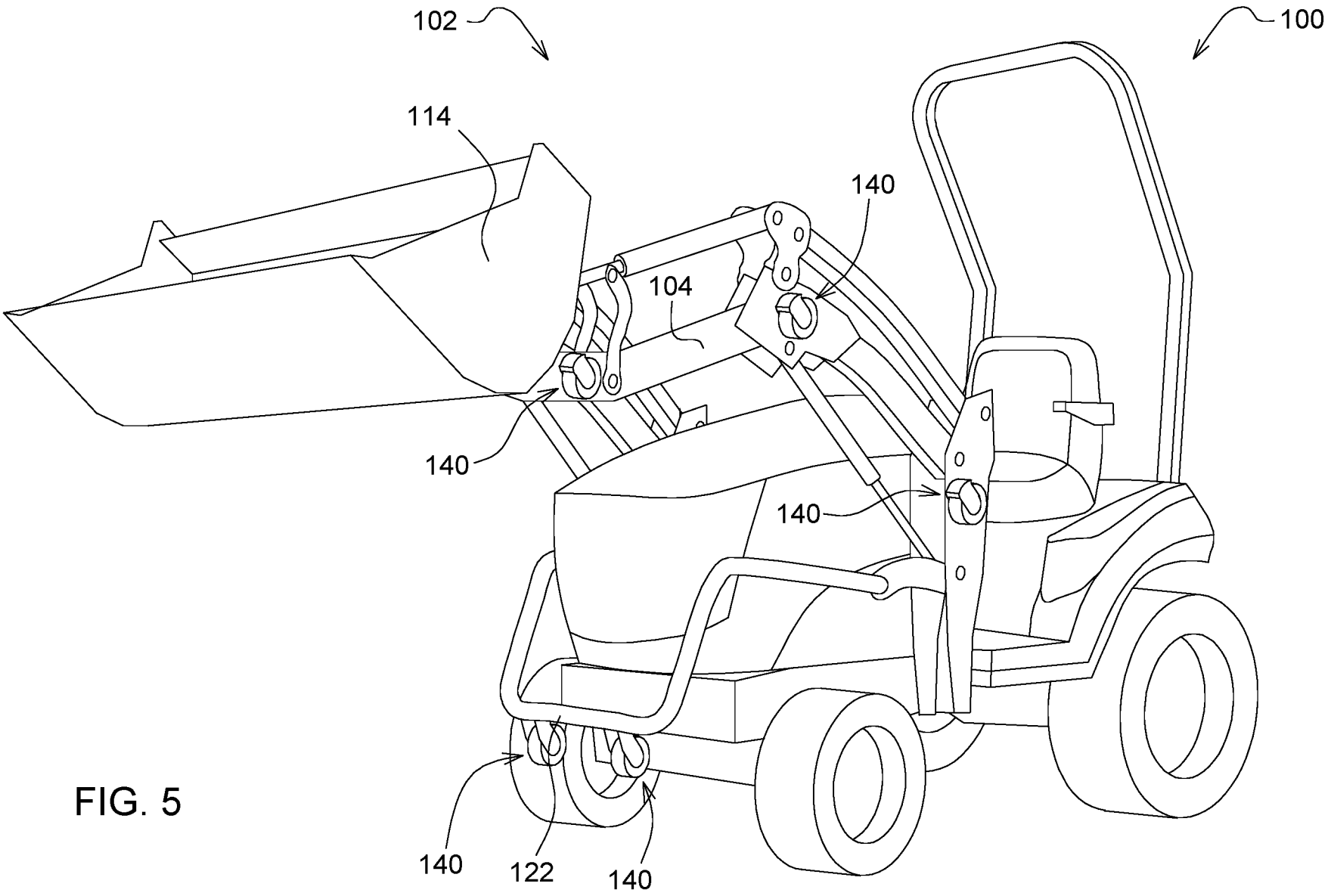
FIG. 5 is a perspective view of a work vehicle including a loader, according to an implementation.

The loader 102 can include a parking stand 122 located on the loader arm 104 and movable between a storage condition, as shown in FIGS. 1 and 5, and a parking condition, as shown in FIGS. 2-4. The parking stand 122 can be in the storage condition when the loader 102 is attached to the work vehicle 100 and in the one or more raised positions during use. The loader 102 can include a storage device 130 to maintain the parking stand 122 in the storage condition. The parking stand 122 can be repositioned to the parking condition when the loader in the lowered position. The parking stand 122 can include a parking support 126 and a ground engagement end 128. The parking stand 122 can include a lock brace 124 to maintain the parking support 126 in the parking condition. The loader 102 includes one or more roller apparatus 140 positioned at various locations to support the loader 102 on a ground surface G when the loader 102 is in the lowered position and detached from the work vehicle 100. Each roller apparatus 140 can be fixedly, removably, or rotatably connected to the loader 102. The roller apparatus 140 can be fixedly, removably, or rotatably attached to the parking stand 122. The roller apparatus 140 can be fixedly, removably, or rotatably attached to one or more of the loader arm 104, the mast section 106, the attachment bracket 112, and the implement 114.

Figure 6B:
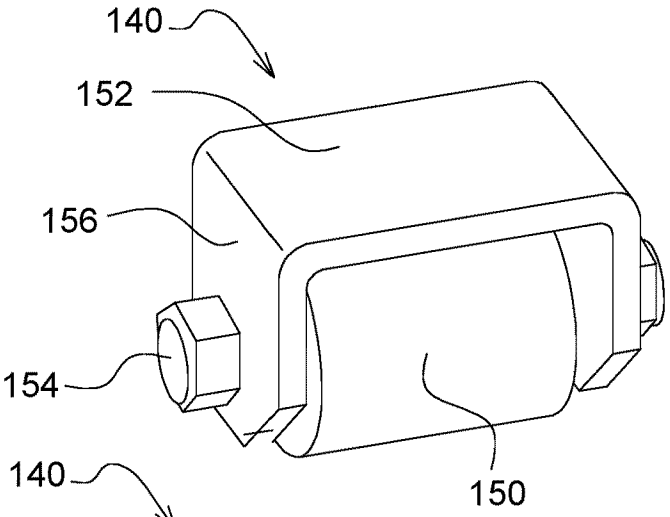
FIGS. 6A-6D are perspective views of a roller apparatus for loader, according to an implementation.

With reference to all the FIGURES, the roller apparatus 140 can include a wheel, a rigid or swivel caster, roller, or other rotating or revolving device 150. The roller apparatus 140 includes a support 152. The roller apparatus 140 includes a spindle or axle 154. The support 152 can include one or more extensions 156 to support the axle 154. The roller apparatus 140 rotates relative to the support 152 about a horizontal axis. The support 152 can connect, attach, or mount directly to the loader 102 with a fastener, adhesive, welding, magnets, or other attachment apparatus. The support 152 can be unitary or integral with the loader 102. The support 152 can include a level surface, as shown for example in FIG. 6B. The support 152 can rotatably connect to the loader 102 so that the roller apparatus 140 can swivel about a vertical axis.

Figure 6D:
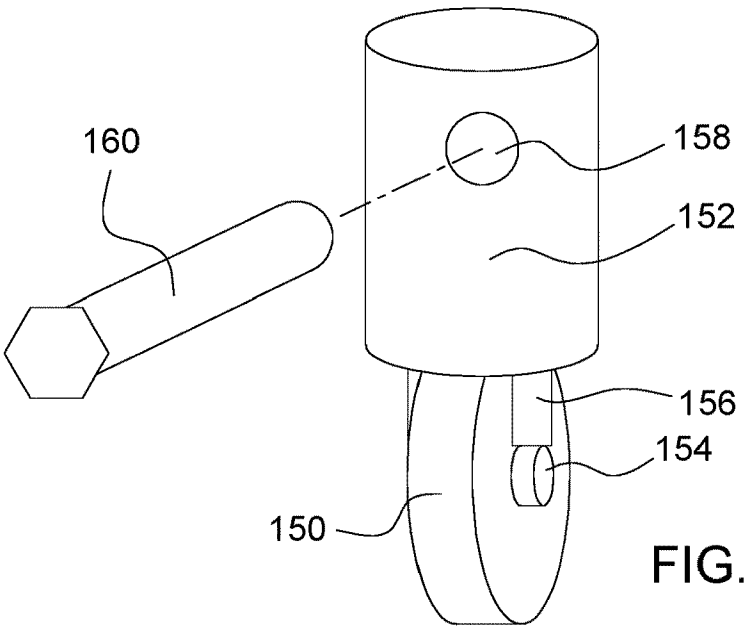
Figure 6A:
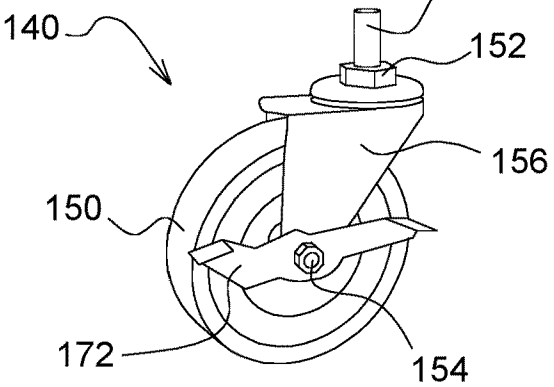
Figure 6C:
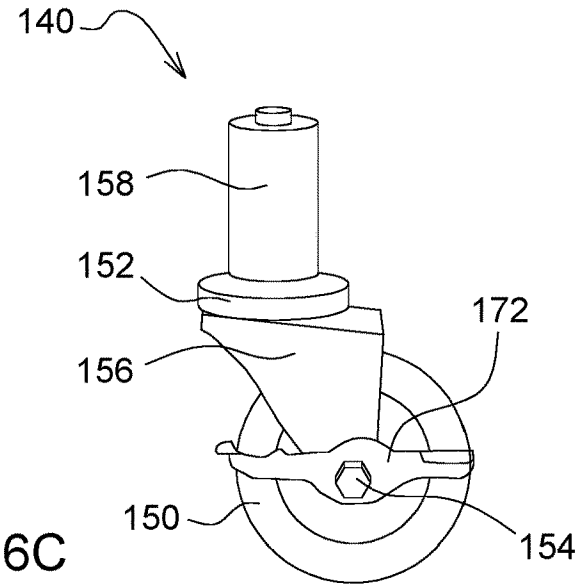
Figure 7B:
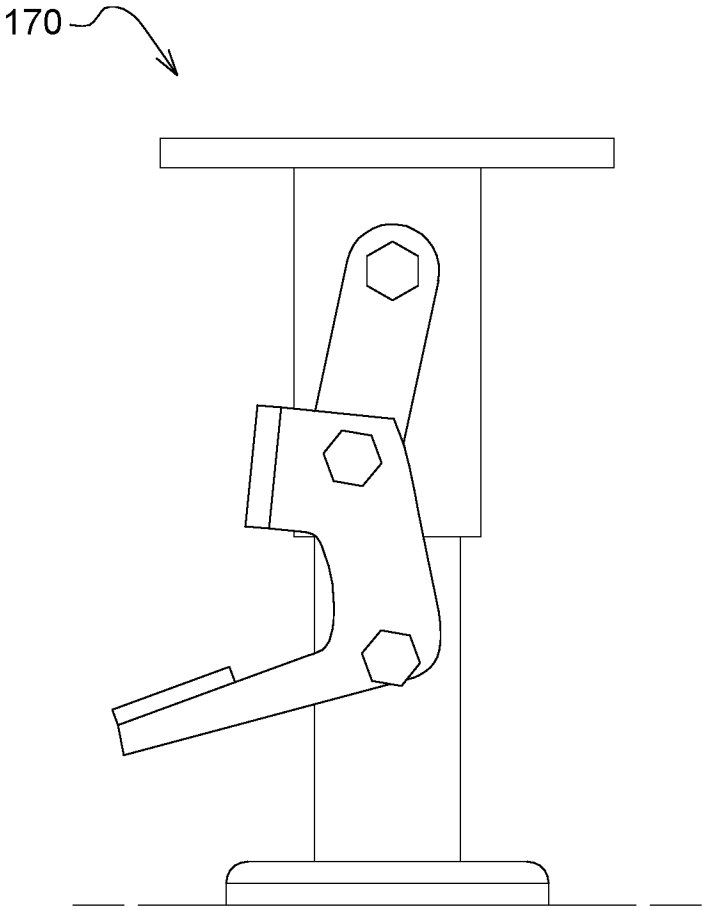
FIGS. 7A-7B are perspective views of a ground engaging lock for a loader, according to an implementation.
Figure 7A:
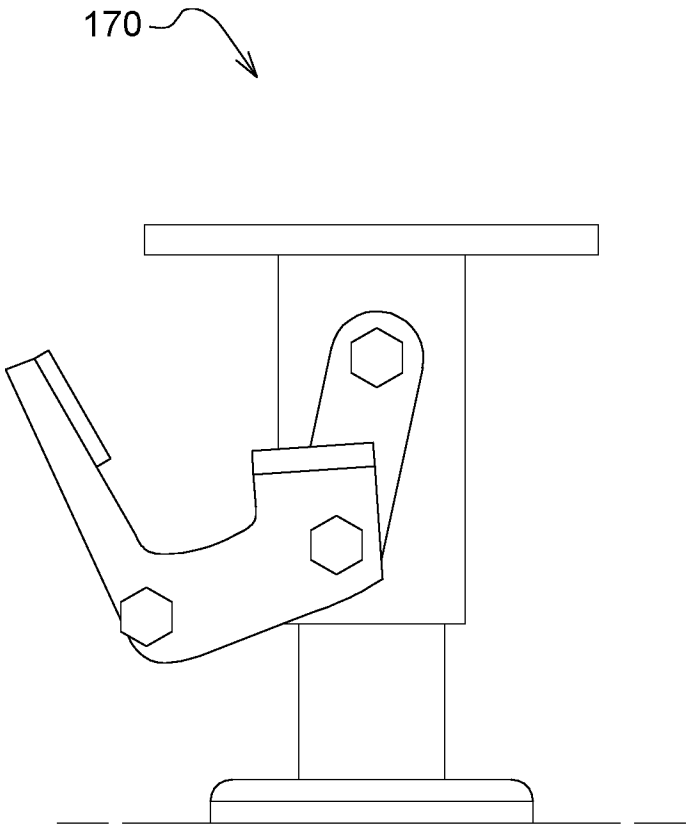

The support 152 can include an attachment feature 158, which can include threads, as shown for example in FIG. 6A. The attachment feature 158 can have a cylindrical or tapered shape, as shown for example in FIGS. 6C and 6D. The attachment feature 158 can include a magnet on a side or on an end. The attachment feature 158 can include an aperture designed to receive a pin, rod, bolt, screw, rivet, or other fastener 160. The roller apparatus 140 can include a brake 172, such as a wheel brake, to selectively allow or prevent movement of the roller apparatus 140 on a ground surface G, as shown for example in FIGS. 6A and 6C. With reference to FIG. 7, a ground engaging lock 170, such as a floor lock, can be positioned on the loader 102. The lock 170 can be positioned on or near the roller apparatus 140. In the disengaged position, the floor lock 170 allows the loader 102 to move on a ground surface G via the one or more roller apparatus 140. In the engaged position, the floor lock 170 contacts the ground surface G and maintains the loader 102 in a preselected location.

With reference to FIGS. 8-12, a mounting device 162 can be fixedly or removably attached to the loader 102. The mounting device 162 can be unitary or integral with the loader 102. The mounting device 162 can be attached to or integral with one or more of the attachment bracket 112, the implement 114, the loader arm 104, and the mast section 106. The mounting device 162 can include a level surface to correspond to the level surface of the support 152. Alternatively, or additionally, the mounting device 162 can include an aperture 164 sized to receive the support 152 of the roller apparatus 140. The mounting device 162 can include a connection feature 168, which can interact or cooperate with the attachment feature 158 of the support 152. The roller apparatus 140 can be installed in the mounting device 162 so that the attachment feature 158 of the support 152 and the connection feature 168 align. The roller apparatus 140 can be removably attached to the mounting device 162. The support 152 of the roller apparatus 140 can be inserted into an aperture 164 within the mounting device 162. The support 152 can be inserted into the bottom or the top of the mounting device 162. The roller apparatus 140 can detach from one end of the mounting device 162 and attach to the other end of the mounting device 162.

Contact or friction between the roller apparatus 140 and the mounting device 162 can retain or hold the support 152 within the aperture 164 of the mounting device 162. The relative shapes and sizes of the support 152 and the aperture 164 of the mounting device 162 can create the contact or friction. The support 152 can have a taper along the length with a larger outer diameter at the end connected to the roller apparatus 140 and a smaller outer diameter at the other end. The mounting device 162 can have a taper along the length with a larger inner diameter at one end or both ends and a smaller inner diameter at the other end or near the middle or center. If the support 152, the mounting device 162, or both have a taper along their length, then the taper can provide the contact to hold the roller apparatus 140 in the mounting device 162.

A fastener 160 can be inserted or installed in the connection feature 168 and attachment feature 158 to hold the support 152 of the roller apparatus 140 within the aperture 164 of the mounting device 162. One or more of the connection feature 168 and attachment feature 158 can include a magnet, detent, pawl, dog, or raised surface. The support 152 and attachment feature 158 can be the same or different apparatus. The roller apparatus 140 can attach to the loader at or near the same location for the use position and the storage position. The roller apparatus can attach to the attachment bracket 112 or the implement 114 in the use position, storage position, or both. The roller apparatus 140 can utilize the same mounting device 162 for the use position and the storage position. The roller apparatus 140 can attach to one end of the mounting device 162 in the use position and another end of the mounting device 162 into the storage position.

Alternatively, the roller apparatus 140 can attach to the loader in a first location for a use position and a different second location for a storage position. The roller apparatus 140 can utilize a first mounting device 162 located near the ground surface G, on the attachment bracket 112 or the implement 114 for example, in the use position and a second mounting device 162 located farther away, or spaced apart, from the ground surface G, on the loader arm 104 or the mast 106 for example, in the storage position. In the use position, the roller apparatus 140 can support the loader 102 on the ground surface G, as shown for example in FIGS. 2-4, 8B, 10B, 11B, 13A, and 14A. In the storage position, the roller apparatus 140 is positioned away, or spaced apart, from the ground surface G, as shown for example in FIGS. 5, 9B, 10C, 12B, 13B, and 14B. the roller apparatus 140 is positioned farther away from the ground surface G in the storage position than the use position.

One or more roller apparatus 140 can be attached to one or more of the loader arm 104, the attachment bracket 112, the implement 114, and the parking stand 122 in the use position, as shown in FIGS. 2-4. One or more roller apparatus 140 can be attached to one or more of the loader arm 104, the attachment bracket 112, the implement 114, and the parking stand 122 in the storage position, as shown in FIG. 5. With reference to FIG. 1, one or more roller apparatus 140 are attached to the attachment bracket 112, the implement 114, or both in the use position; and one or more roller apparatus 140 are attached to the parking stand 122 in the storage position.

Figure 8B:
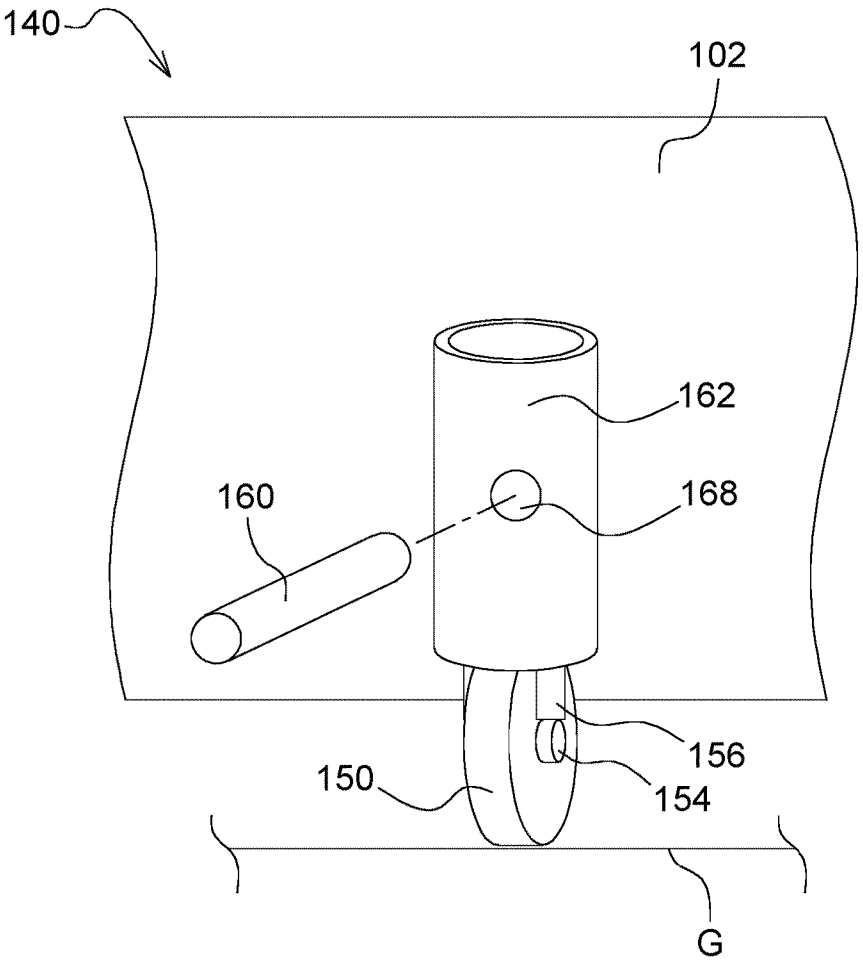
FIGS. 8A-8B are perspective views of a roller apparatus for a loader, according to an implementation.
Figure 8A:
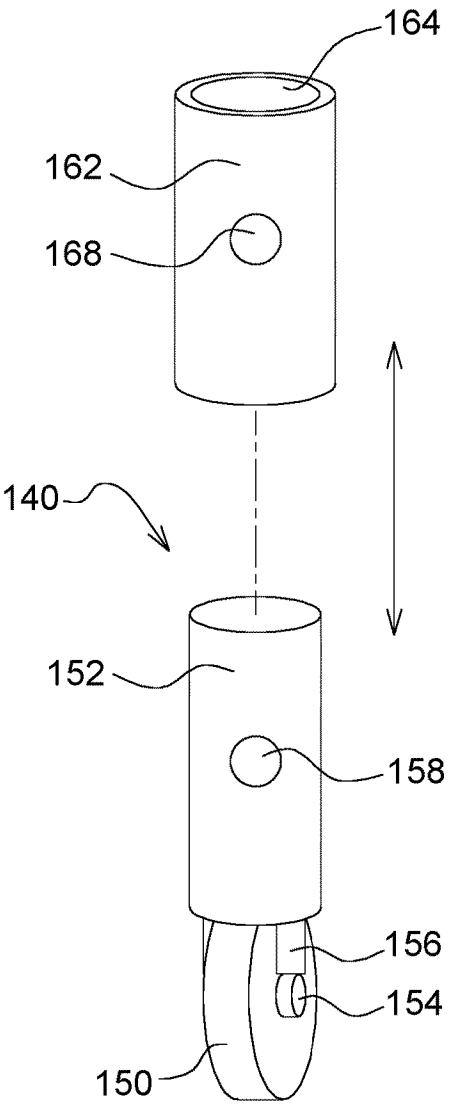
Figure 9B:
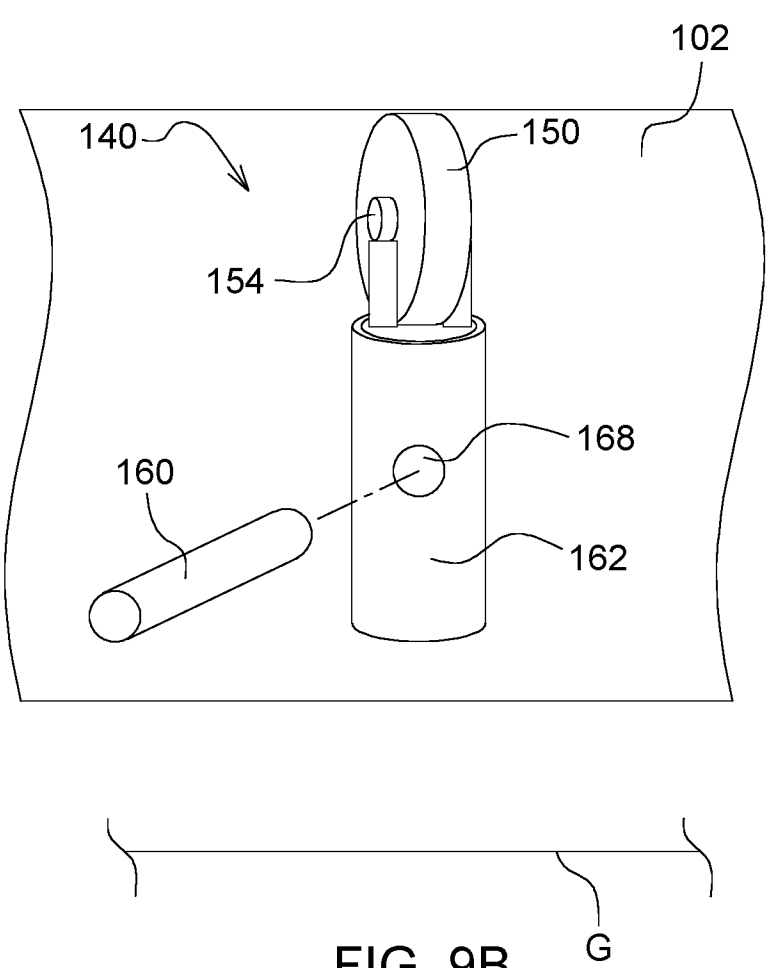
FIGS. 9A-9B are perspective views of a roller apparatus for a loader, according to an implementation.
Figure 9A:
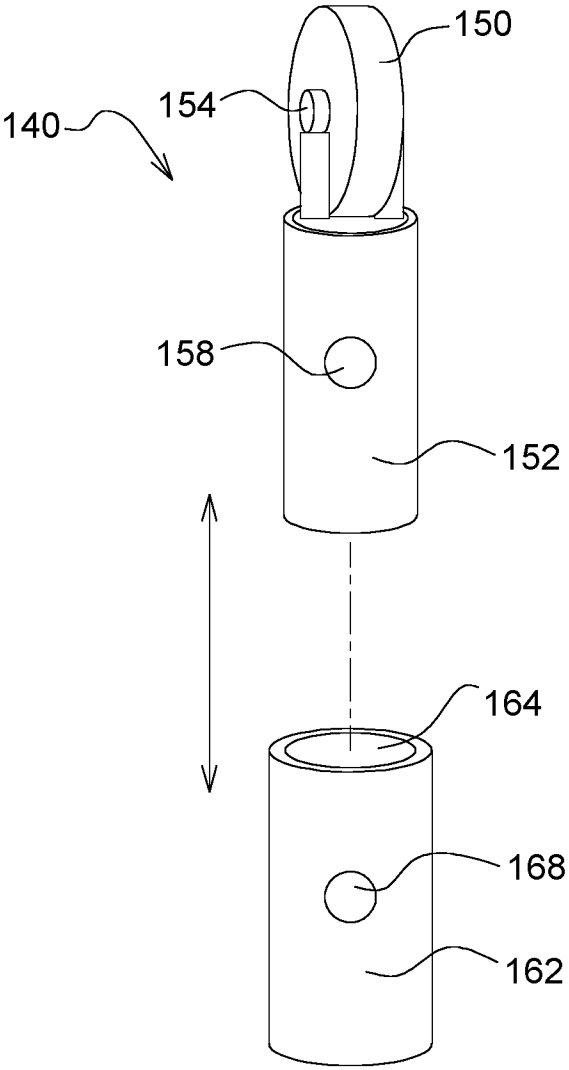
Figure 11B:
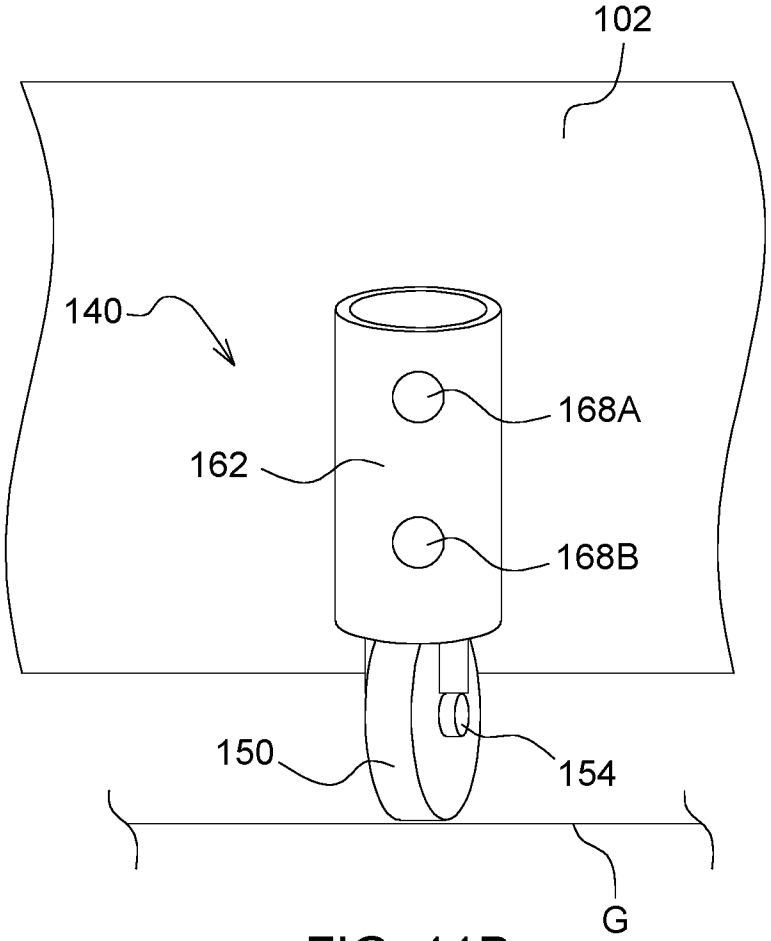
FIGS. 11A-11B are perspective views of a roller apparatus for a loader, according to an implementation.
Figure 11A:
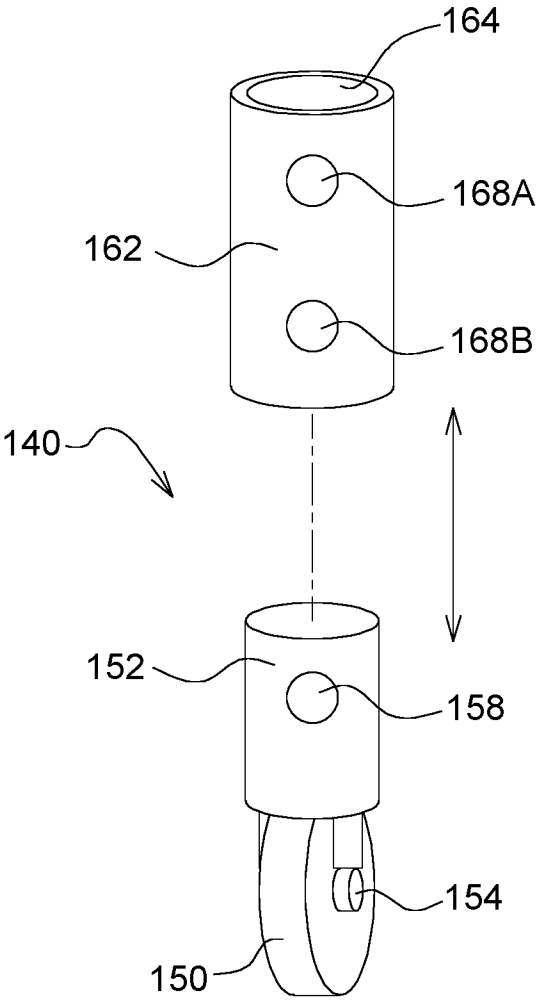
Figure 12B:
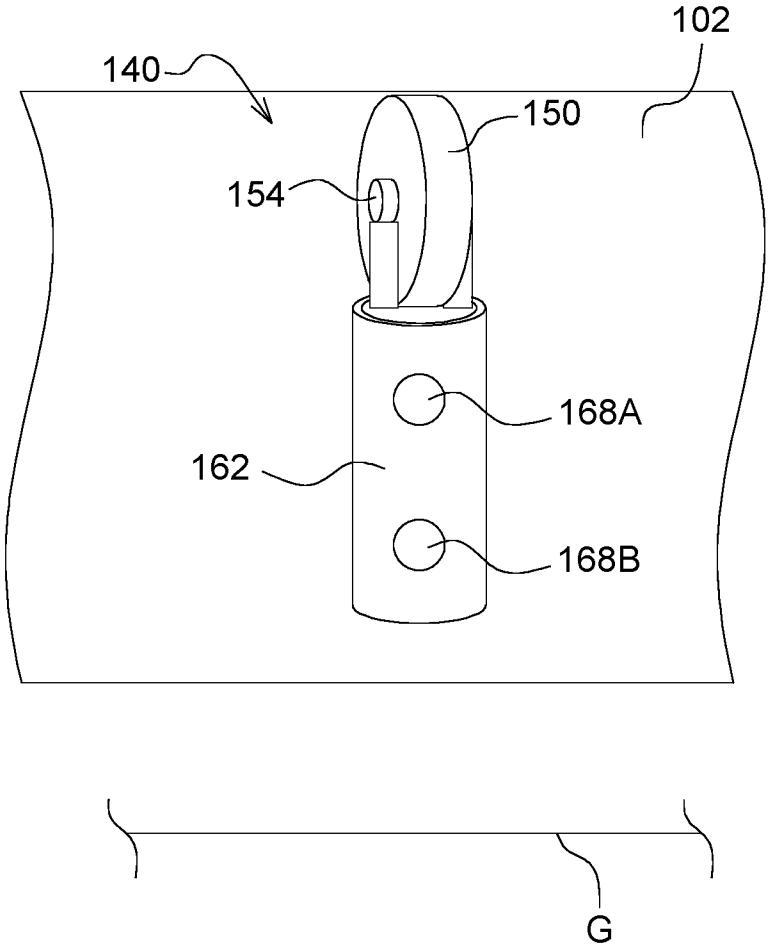
FIGS. 12A-12B are perspective views of a roller apparatus for a loader, according to an implementation.
Figure 12A:
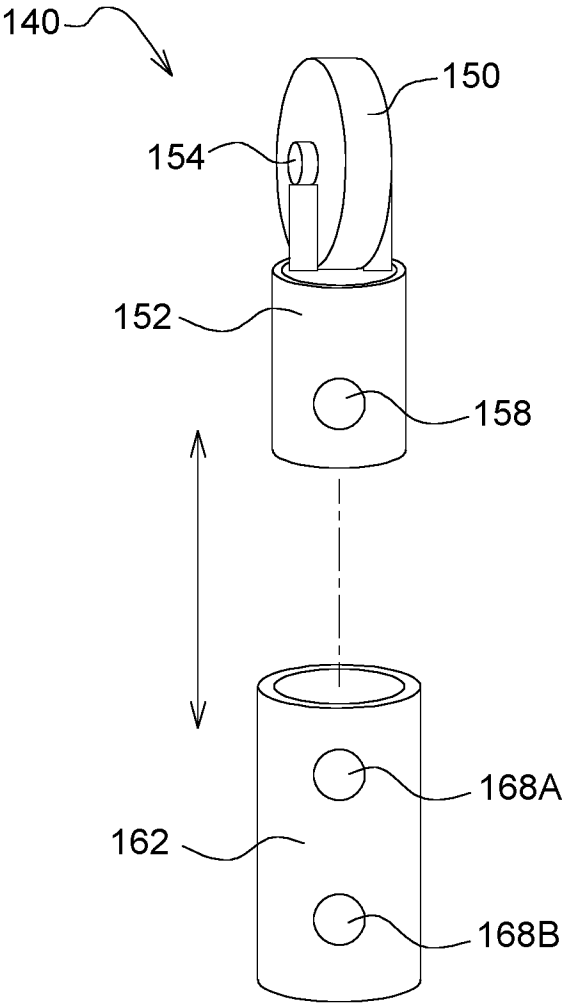

The roller apparatus 140 can be attached, inserted, or installed in a lower portion of the mounting device 162 for the use position, as shown in FIGS. 8A-8B and 11A-11B. The roller apparatus 140 can be attached, inserted, or installed in an upper portion of the mounting device 162 for the storage position, as shown in FIGS. 9A-9B and 12A-12B. The attachment feature 158 of the support 152 can align with the connection feature 168 of the mounting device 162 in the use position, as shown in FIG. 8B. The attachment feature 158 of the support 152 can align with the connection feature 168 of the mounting device 162 in the storage position, as shown in FIG. 9B. In some implementations, the mounting device 162 can include a plurality of connection features 168. The attachment feature 158 of the support 152 can align with a lower connection feature 168B of the mounting device 162 for the use position, as shown in FIG. 11B. The attachment feature 158 of the support 152 can align with an upper connection feature 168A of the mounting device 162 for the storage position, as shown in FIG. 12B. In some implementations, a fastener 160 can be used to maintain the roller apparatus 140 in the mounting device 162.

Figure 10C:
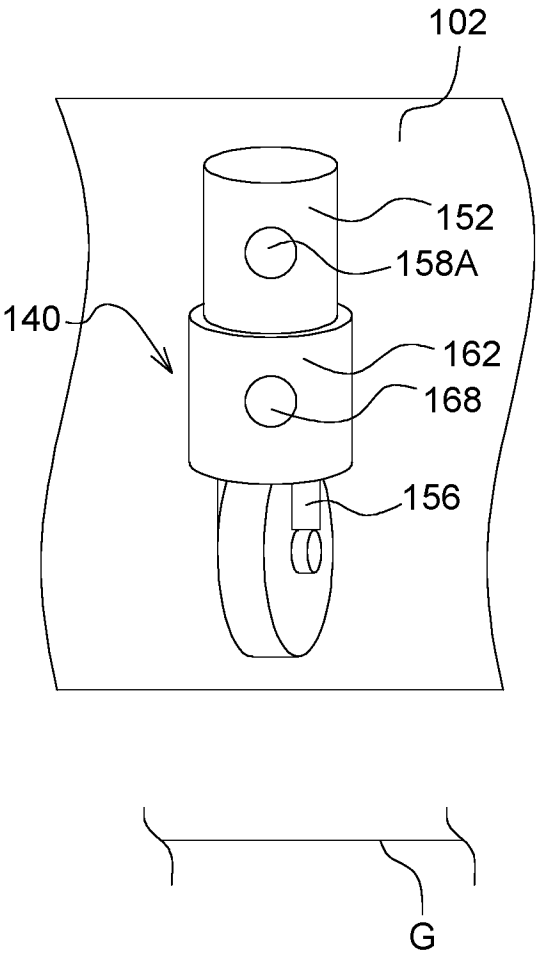
FIGS. 10A-10C are perspective views of a roller apparatus for a loader, according to an implementation.
Figure 10B:
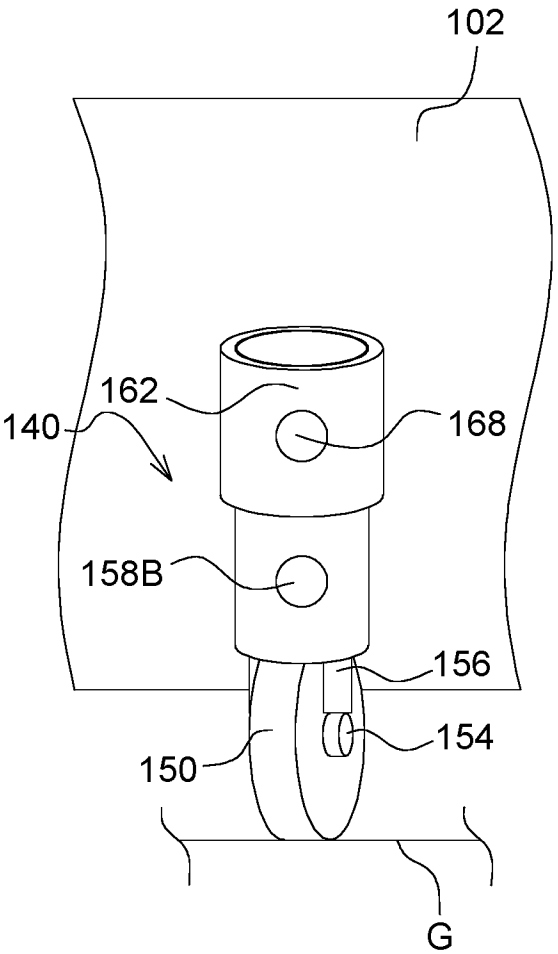
Figure 10A:
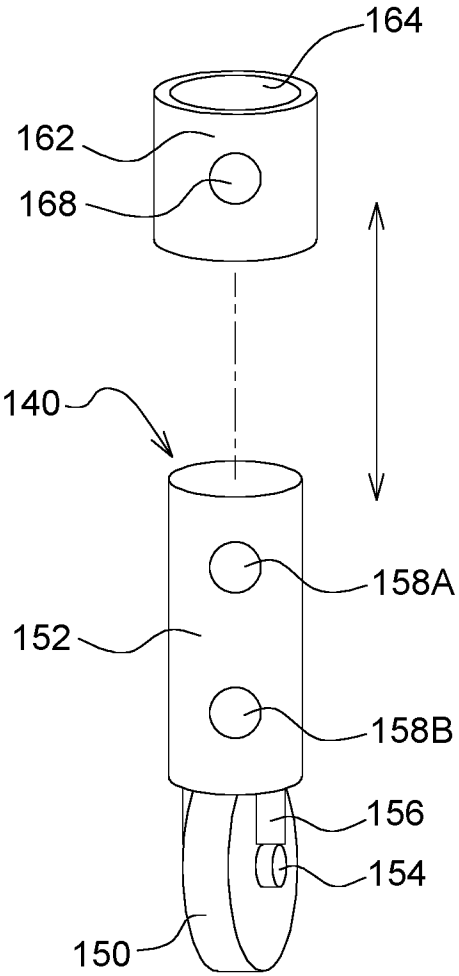

With reference to FIGS. 10A-10C, the roller apparatus 140 can be inserted or installed in a lower portion of the mounting device 162 for both the use position and the storage position. In some implementations, the support 152 can include a plurality of attachment features 158. When an upper attachment feature 158A of the support 152 aligns with the connection feature 168 of the mounting device 162, the roller apparatus 140 is in the use position, as shown in FIG. 10B. When a lower attachment feature 158B of the support 152 aligns with the connection feature 168 of the mounting device 162, the roller apparatus 140 is in the storage position, as shown in FIG. 10C.

Figure 13B:
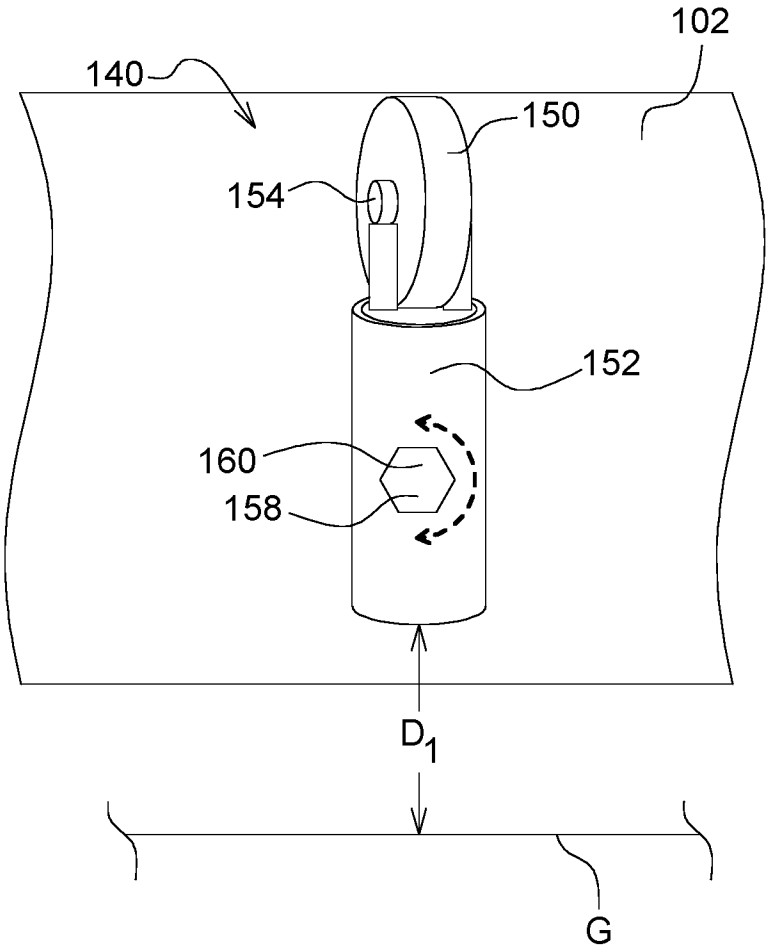
FIGS. 13A-13B are perspective views of a roller apparatus for a loader, according to an implementation.
Figure 13A:
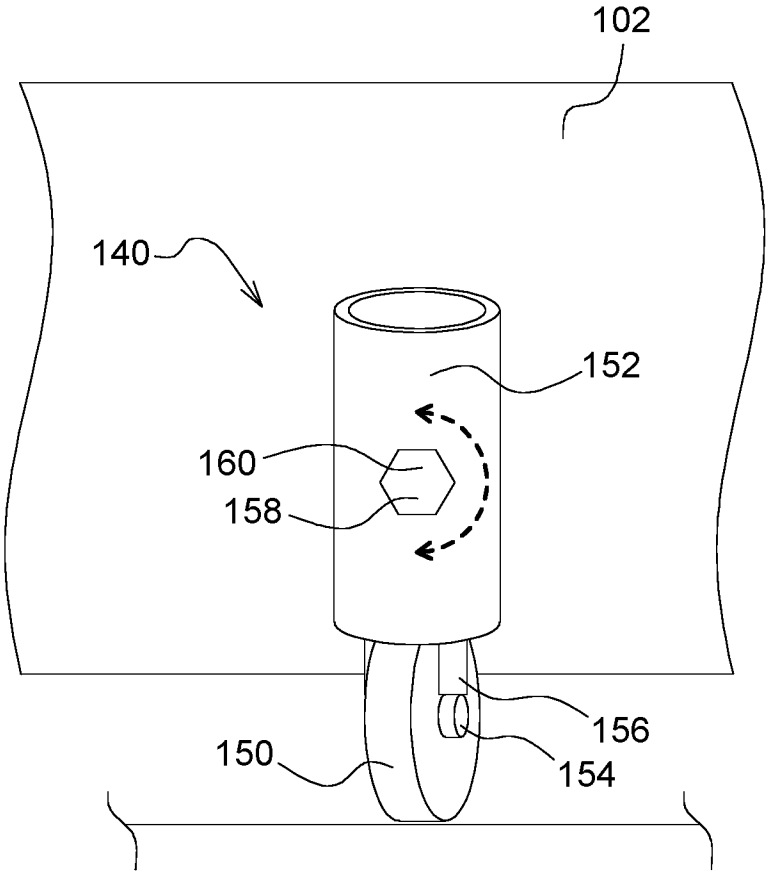
Figure 14B:
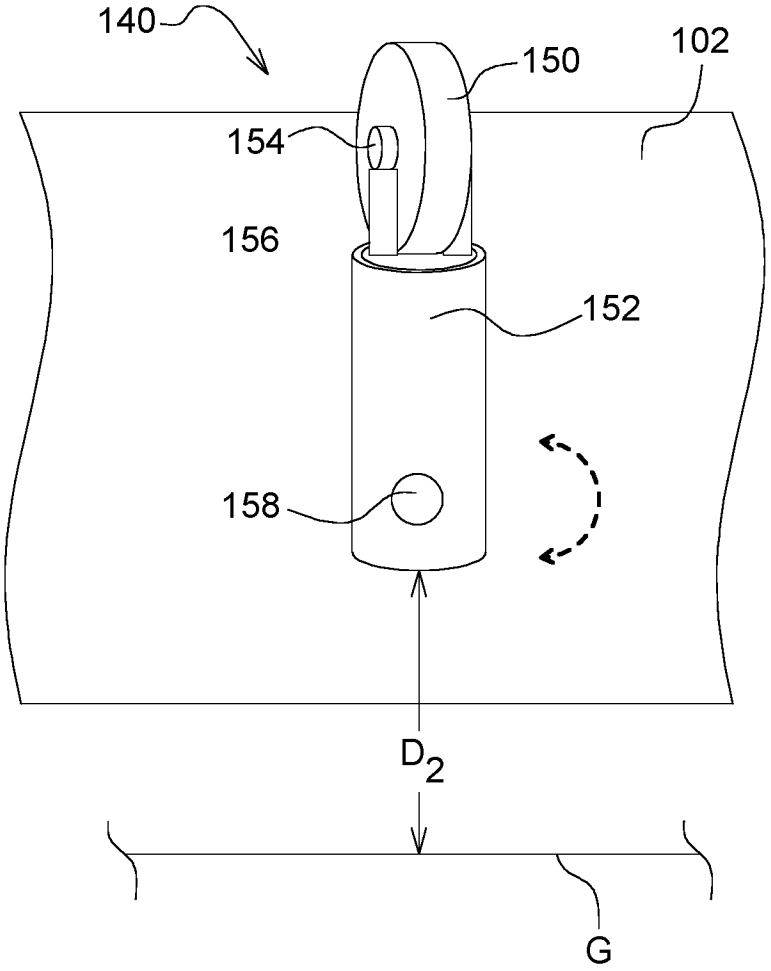
FIGS. 14A-14B are perspective views of a roller apparatus for a loader, according to an implementation.
Figure 14A:
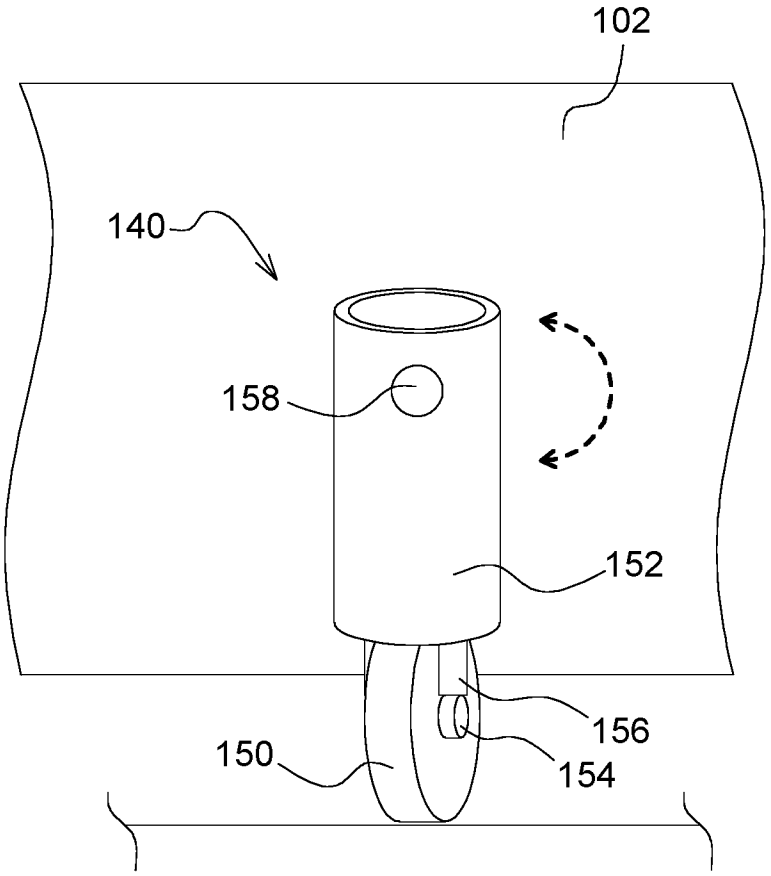

With reference to FIGS. 13A-13B and 14A-14B, the roller apparatus 140 can rotatably attach to the loader 102. The roller apparatus 140 can rotate from a use position, as shown in FIGS. 13A and 14A, to a storage position, as shown in FIGS. 13B and 14B. The support 152 can rotatably connect to the loader 102 via the attachment feature 158. Any type of fastener 160 can be inserted into the aperture of the attachment feature 158 to rotatably attach the roller apparatus 140 to the loader 102. The roller apparatus 140 can pivot around the fastener 160. The attachment feature 158 can be located at any position on the support 152. The attachment feature 158 can be located near the center or middle of the support 152 such that the roller apparatus 140 is located a distance $D_1$ from the ground surface G in the storage position, as show for example in FIG. 13B. The attachment feature 158 can be located near an end of the support 152 such that the roller apparatus 140 is located a farther distance D2 from the ground surface G in the storage position, as show for example in FIG. 14B.

According to some implementations, the loader 102 can include one or more roller apparatus 140 attached to the parking stand 122 and one or more roller apparatus 140 attached to the loader arm 104, the attachment bracket 112, or the implement 114. One or more roller apparatus 140 can be fixedly attached to the parking stand 122. When the parking stand 122 is in the storage condition, the one or more attached roller apparatus 140 are in the storage position. When the parking stand 122 is in the parking condition, the one or more attached roller apparatus 140 are in the use position. One or more roller apparatus 140 can be rotatably or removably attached to the loader arm 104, the attachment bracket 112, or the implement 114. One or more roller apparatus 140 can be attached to one or more of the loader arm 104, the attachment bracket 112, and the implement 114 in the use position. One or more roller apparatus 140 can be attached to one or more of the loader arm 104, the mast section 106, the attachment bracket 112, and the implement 114 in the storage position.

With reference to FIGS. 15-22, a connector 180 can connect or attach to the loader 102. The connector 180 provides a connection for another vehicle, such as a forklift, truck, compact tractor, compact track loaders, or skid steer loader, to connect or attach to the loader 102 for repositioning or relocating the loader 102. The connector 180 can include a drawbar, hitch, or coupler. The connector 180 can include one or more rigid members 182, such as a rod or bar, a hitch 184, and one or more attachment portions 186. The one or more rigid members 182 can be hollow or solid. The one or more rigid members 182 can include circular or square tubing. The one or more rigid members 182 can be fixedly, rotatably, or removably attached to the hitch 184. The one or more rigid members 182 can be pivotally connected to the hitch to move closer together or farther away from each other. The hitch 184 can include a ball and hitch, a pintle hitch, or any other type of hitch. The one or more attachment portions 186 can include posts, hooks, eyelets, rings, apertures, or fasteners. The connector 180 can attach to an upper or top portion of the implement 114. The connector 180 can be fixedly, rotatably, or removably attached to the implement 114.

Figure 15:
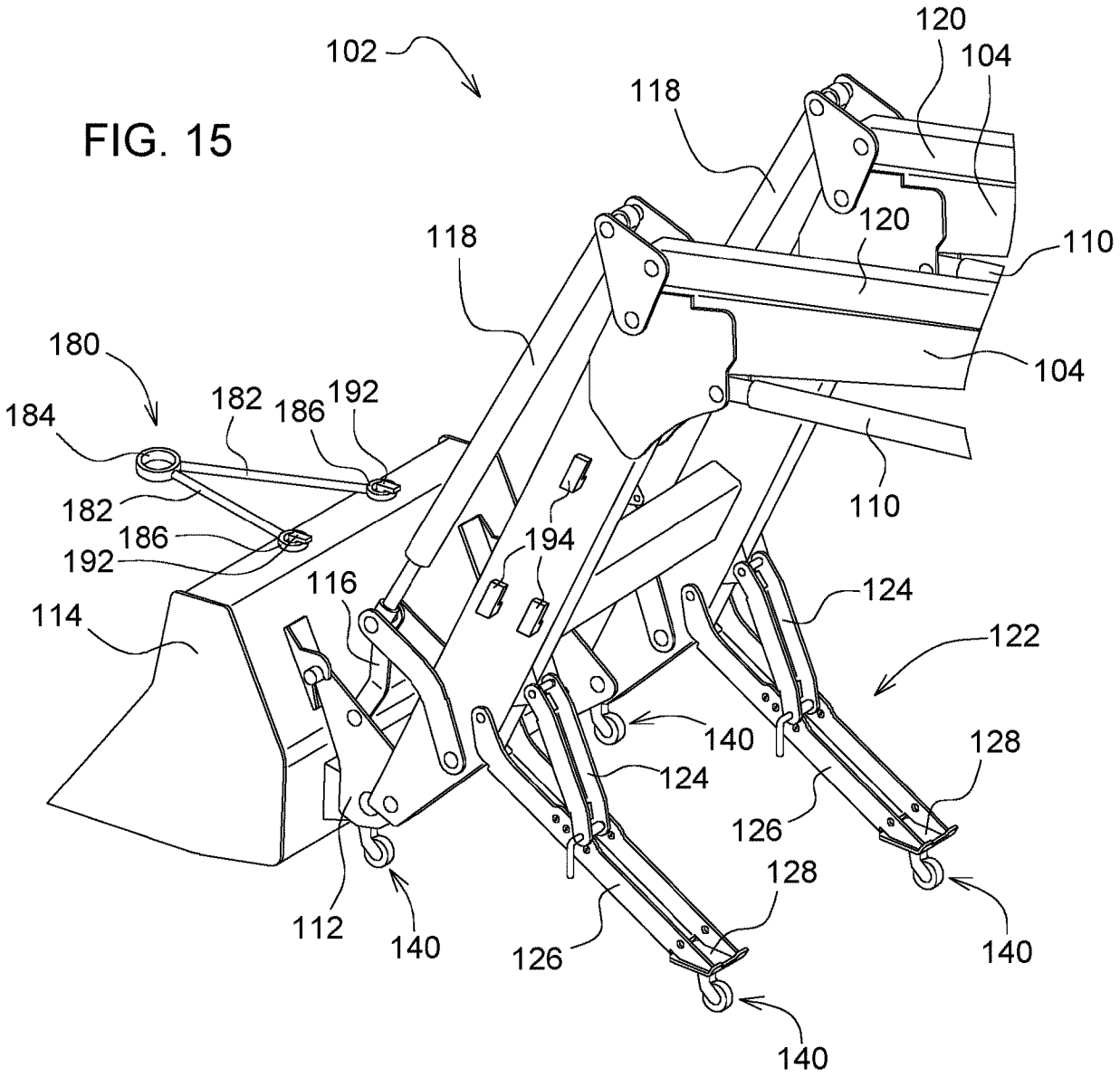
FIG. 15 is a perspective view of a connector for a loader, according to an implementation.
Figure 16:
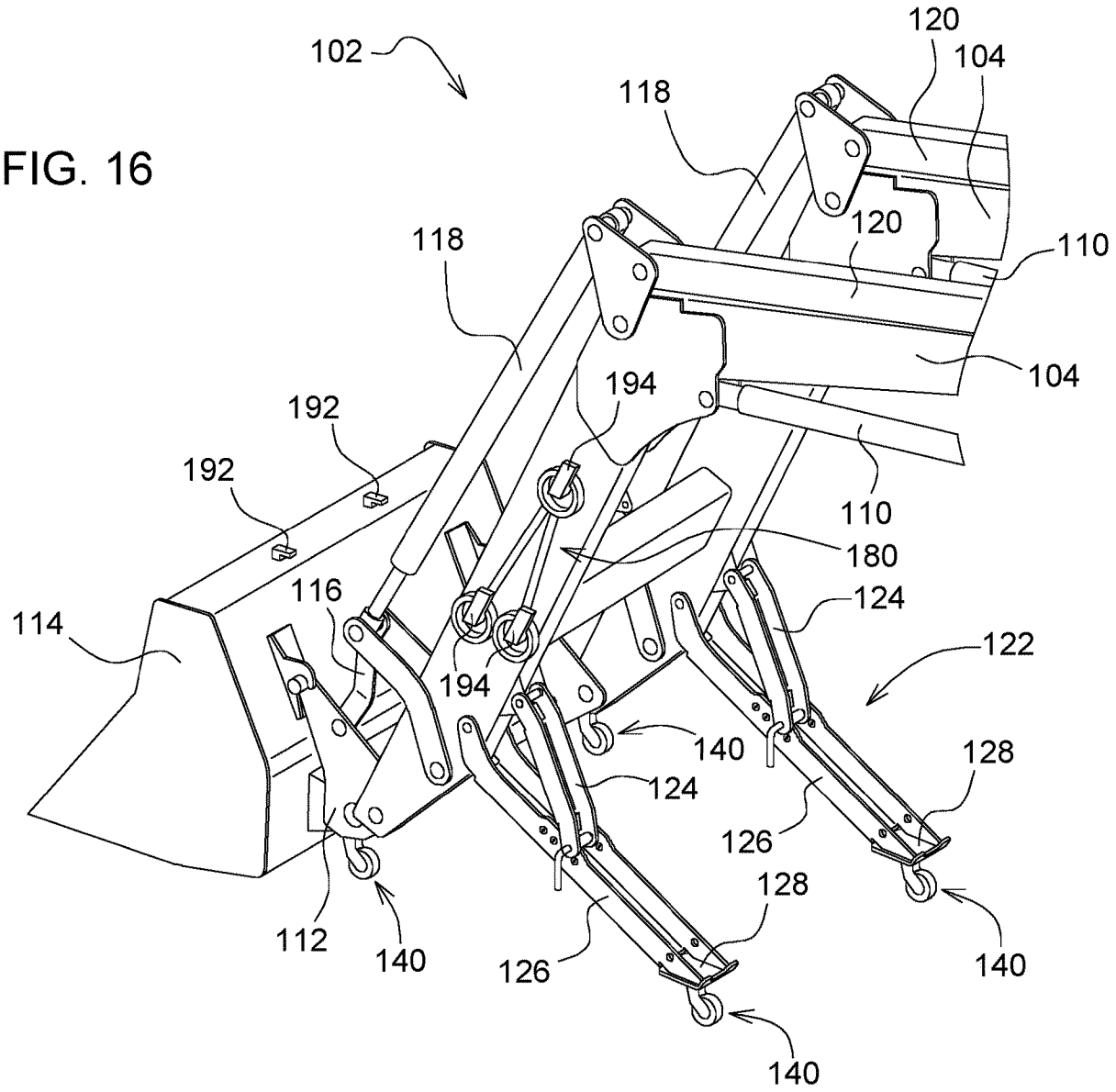
FIG. 16 is a perspective view of a connector for a loader, according to an implementation.
Figure 17:
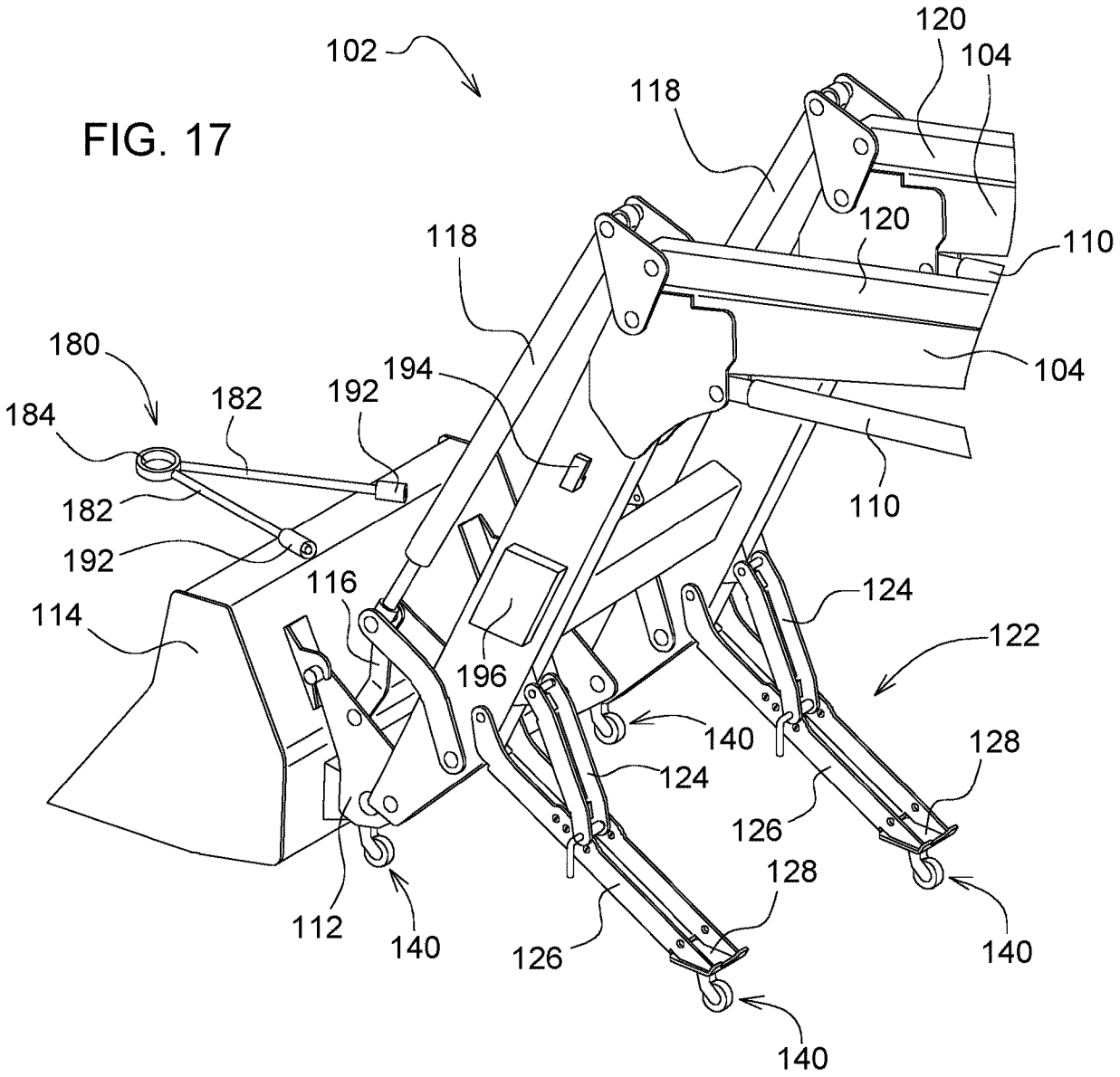
FIG. 17 is a perspective view of a connector for a loader, according to an implementation.
Figure 18:
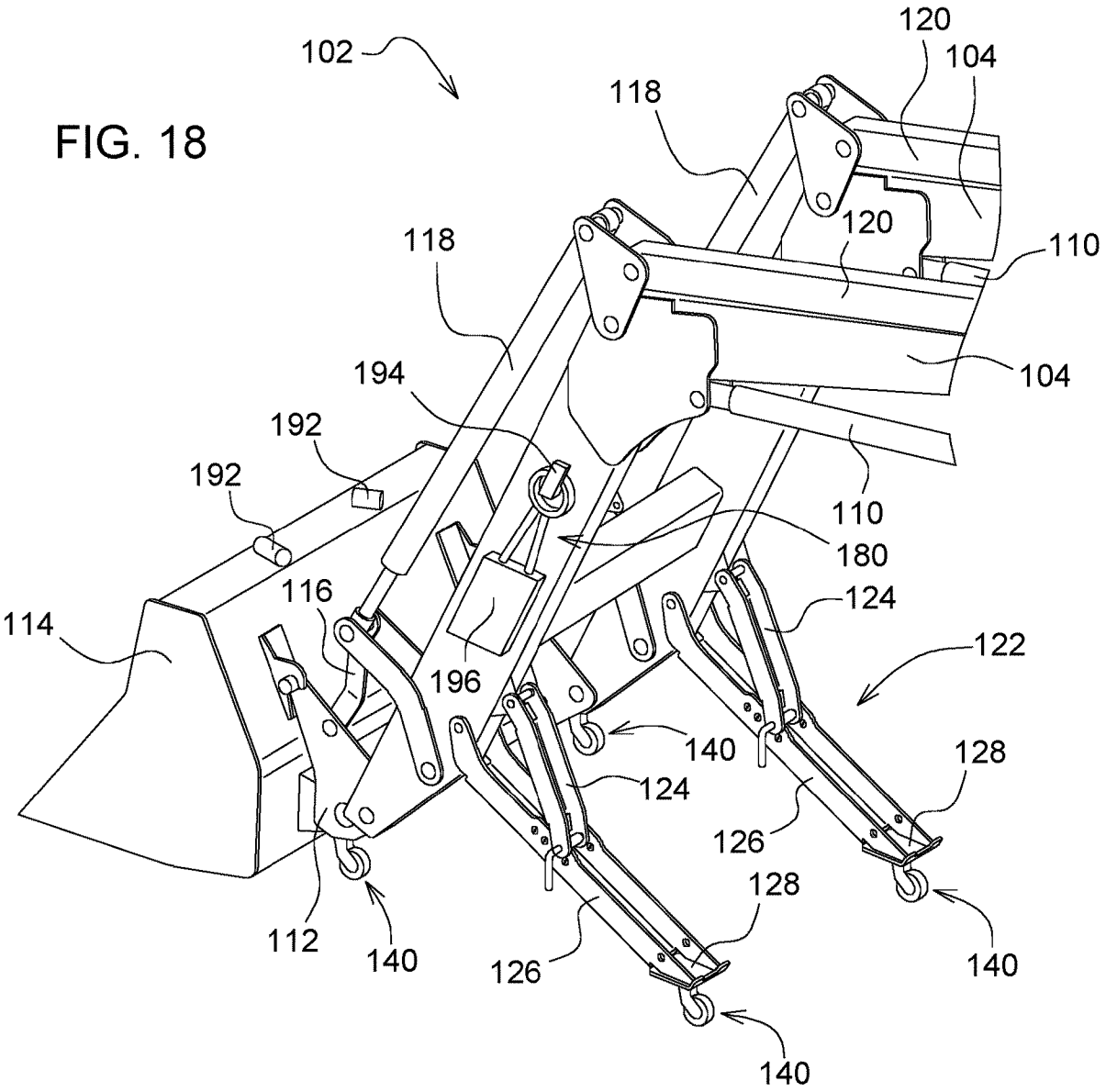
FIG. 18 is a perspective view of a connector for a loader, according to an implementation.

The connector 180 can be removably attached to the implement 114 with the connector 180 attached to the implement 114 in a use position, as shown in FIGS. 15 and 17, and attached to the loader arm 104 in a storage position, as shown in FIGS. 16 and 18. The implement 114 can include one or more support portions 192. The one or attachment portions 186 of the connector 180 can connect or attach to the one or more support portions 192 of the implement 114 in the use position. The one or more support portions 192 can include posts, hooks, eyelets, rings, tubes, sleeves, or fasteners. The one or more support portions 192 can be T-shaped or L-shaped. The one or more support portions 192 can be tubular. The one or more support portions 192 can be fixedly, removably, or rotatably attached to the implement 114. The one or more support portions 192 can be unitary or integral with the implement 114.

The loader 102 can include one or more support portions 194 on the loader arm 104. The attachment portions 186 of the connector 180 can connect or attach to the one or more support portions 194 of the loader arm 104 in the storage position. The one or more support portions 194 can include posts, hooks, eyelets, rings, tubes, sleeves, or fasteners. The one or more support portions 192 can be T-shaped or L-shaped. The one or more support portions 194 can be fixedly, removably, or rotatably attached to the loader arm 104. The one or more support portions 194 can be unitary or integral with the loader arm 104. The loader 102 can include a sleeve 196 on the loader arm 104 for receiving the connector 180 in the storage position. The sleeve 196 can be used with or without the one or more support portions 194. The sleeve 196 can be fixedly, removably, or rotatably attached to the loader arm 104. The sleeve 196 can be unitary or integral with the loader arm 104.

Figure 19A:
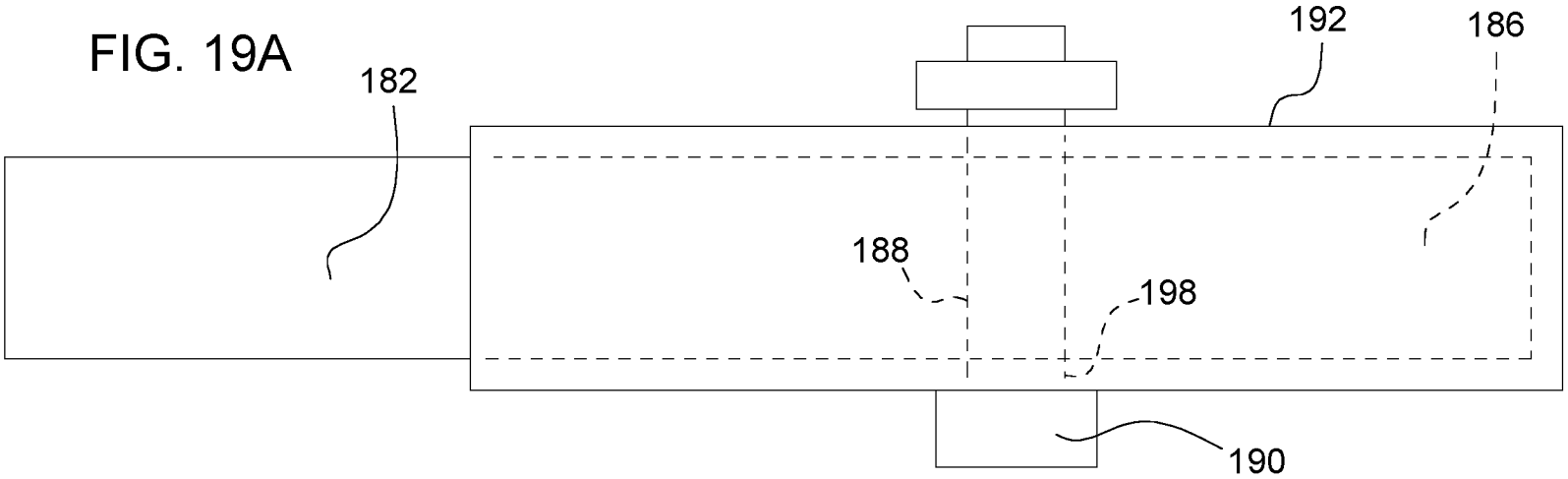
FIG. 19A is a top perspective view of a connector for a loader, according to an implementation.
Figure 19B:
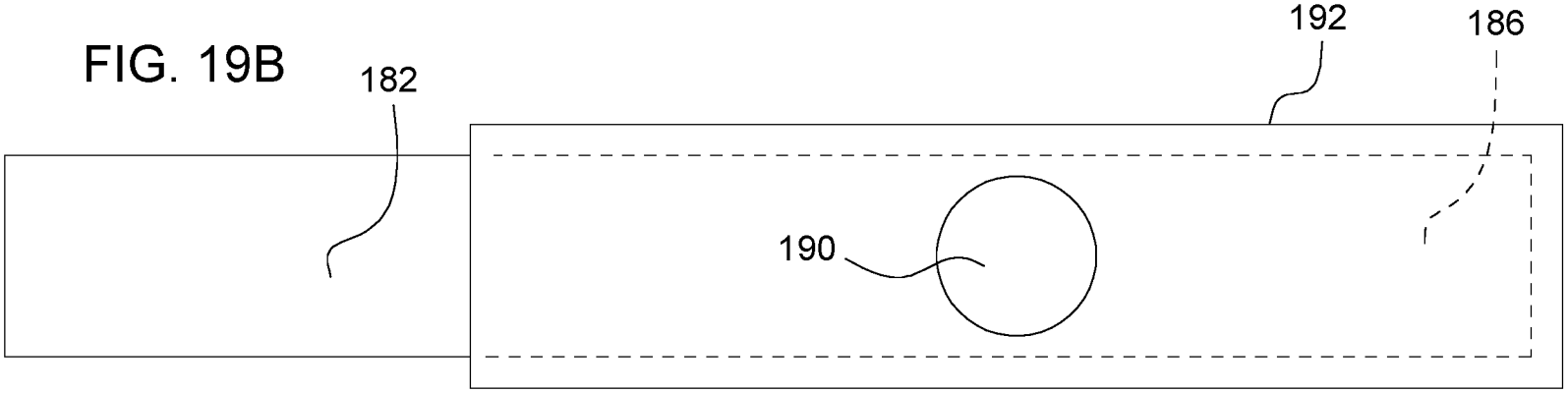
FIG. 19B is a side perspective view of a connector for a loader, according to an implementation.

With reference to FIGS. 19A-19B, the one or more support portions 192, the one or more support portions 194, or both, can include a hollow receiver portion. The attachment portion 186 of the rigid member 182 can be inserted into the receiver portion of the support portion 192 or the support portion 194. A fastener 190, such as a pin or bolt, can be inserted into an aperture 198 in the support portion 192 or support portion 192 and an aperture 188 in the attachment portion 186 to removably attach the connector 180 to the loader 102.

Figure 20:
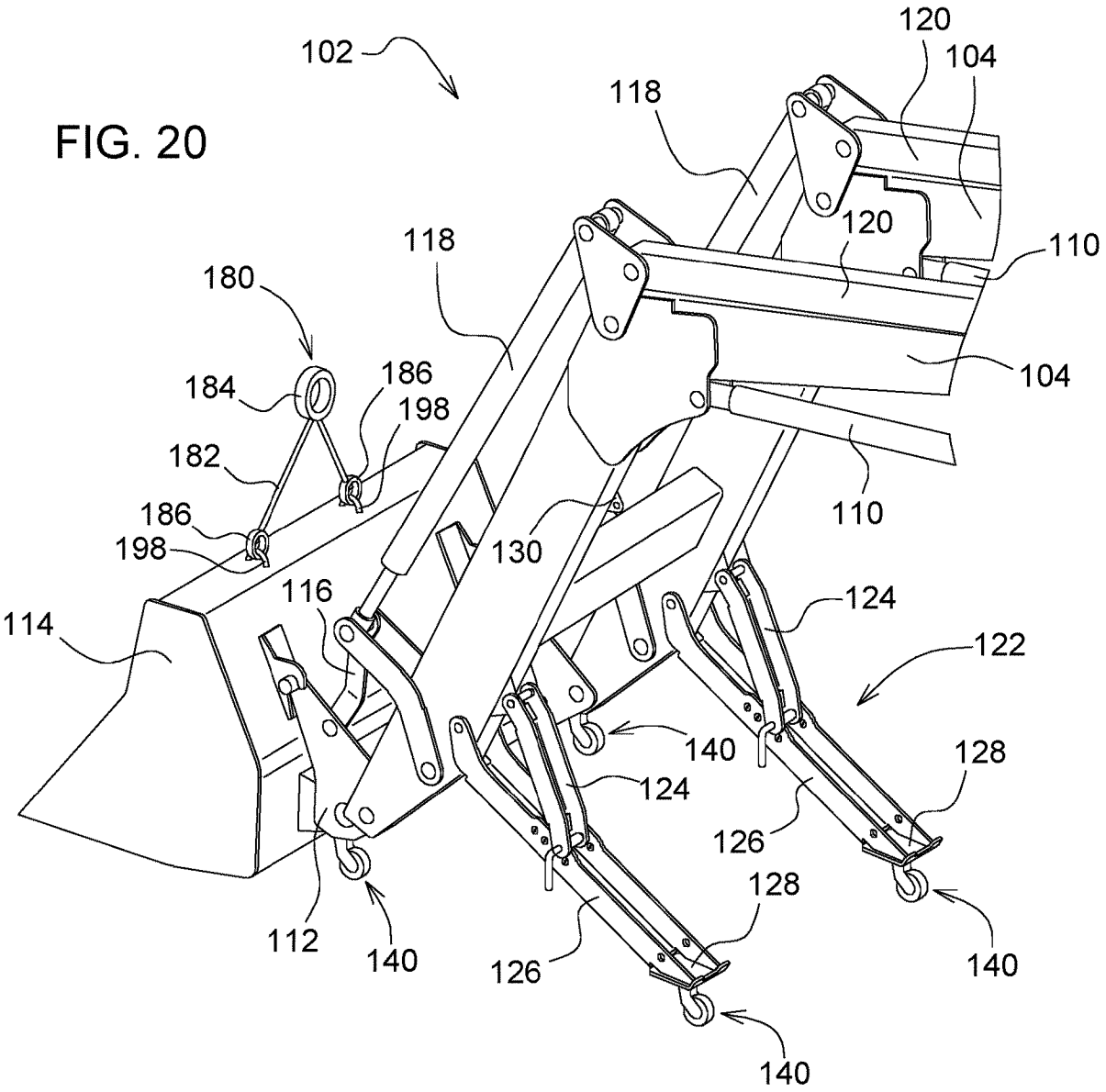
FIG. 20 is a perspective view of a connector for a loader, according to an implementation.
Figure 21:
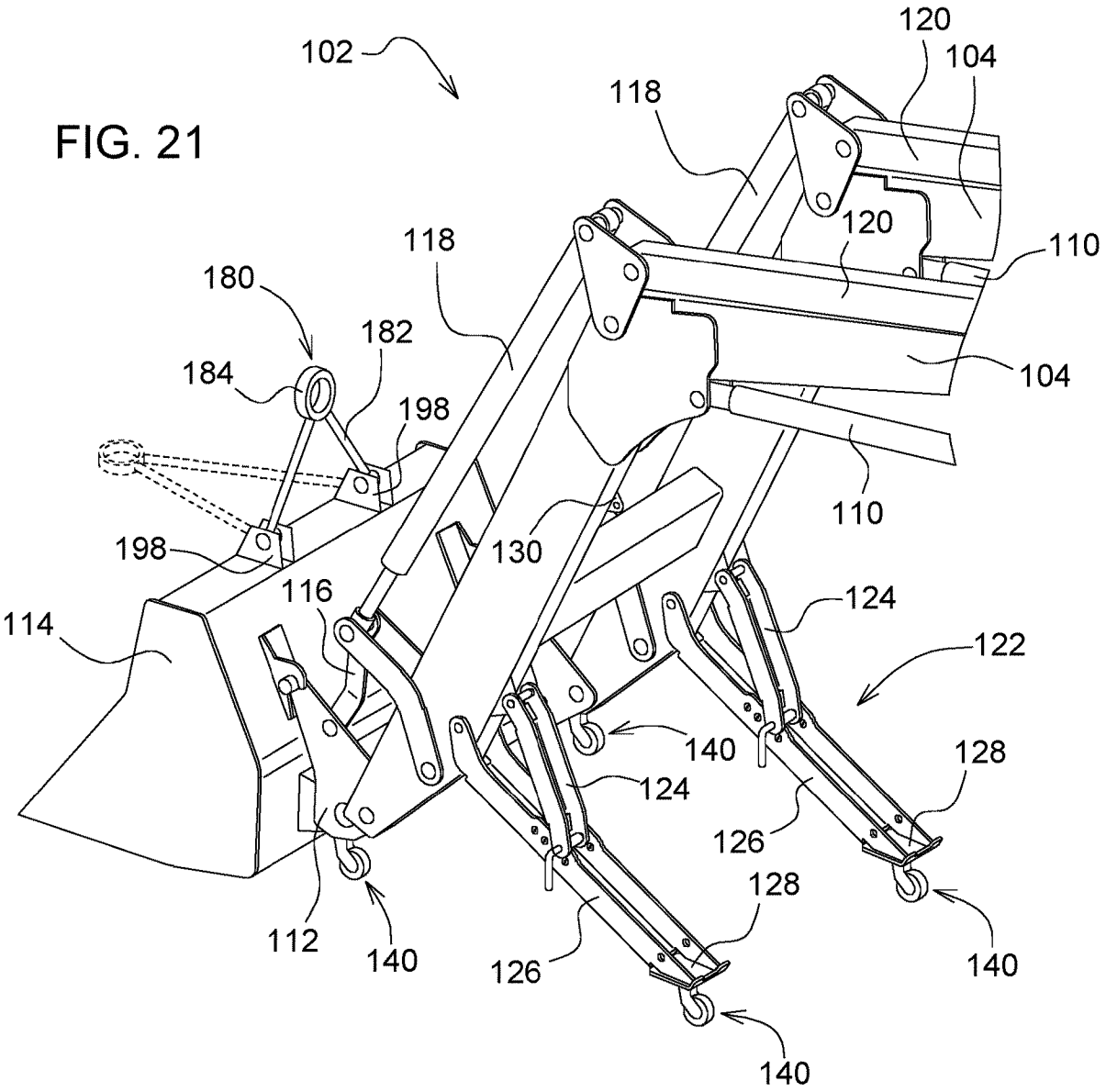
FIG. 21 is a perspective view of a connector for a loader, according to an implementation.
Figure 22:
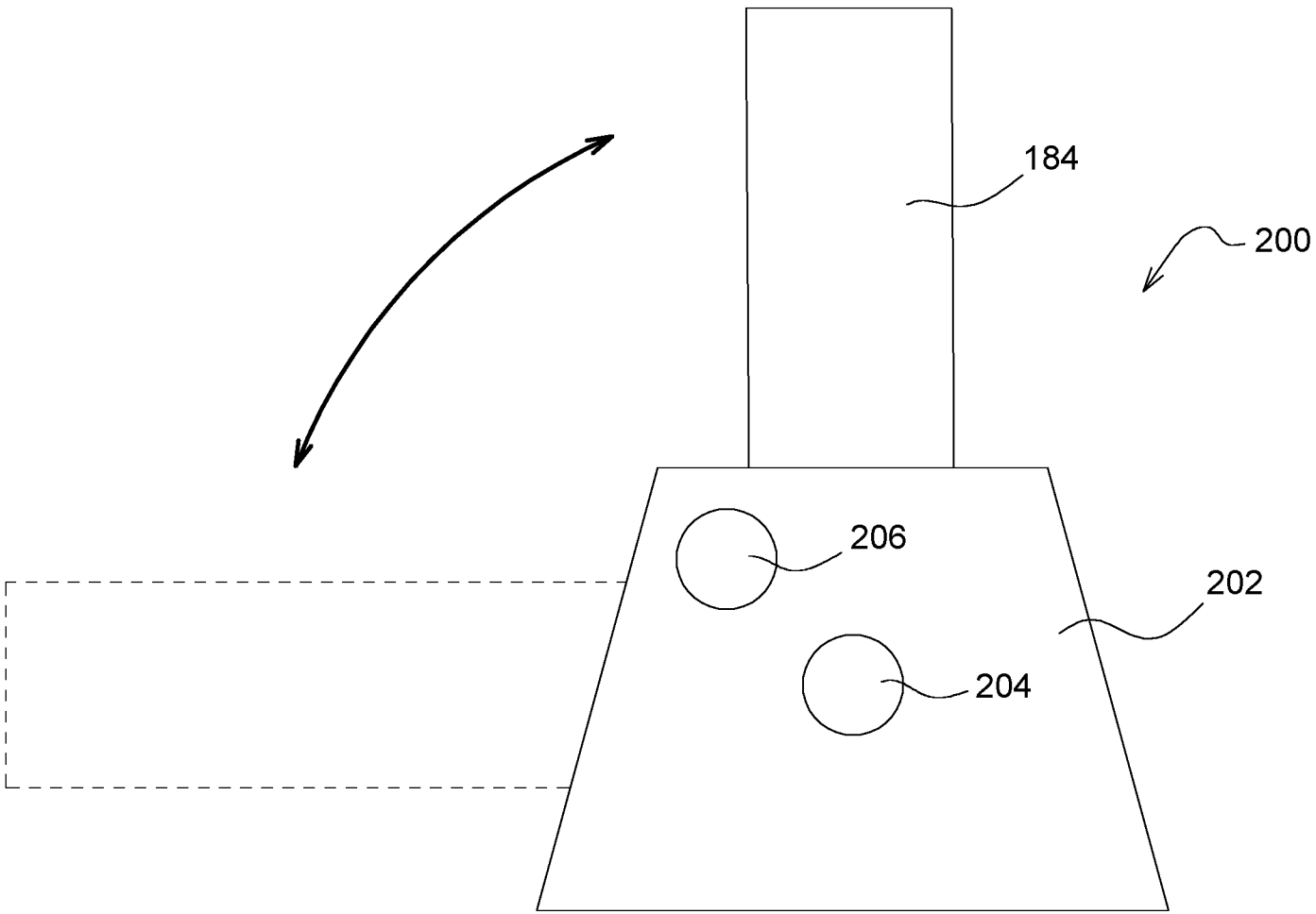
FIG. 22 is a side perspective view of a connector for a loader, according to an implementation.

Alternatively, or additionally, the connector 180 can be rotatably attached to the implement 114 via a hinge or other rotatable device 200 allowing the connector 180 to rotate between a use position and a storage position, as shown in FIGS. 20-22. The hinge 200 can include any type of hinge including, but not limited to, interconnecting links or rings, a bracket and fastener, a clevis and pin, and butt or strap hinges. With reference to FIG. 22, the hinge 200 can include a bracket 202, a pivot connection 204, and an aperture 206. A fastener can be inserted into the aperture 206 to fix or secure the connector 180 in each of the use position and the storage position. The fastener can be removed from the aperture 206 before the connector 180 is repositioned in one of the use and storage positions and then the fastener is reinserted.

Without in any way limiting the scope, interpretation, or application of the claims appearing below, a technical effect of one or more of the example implementations disclosed herein is one or more roller apparatus attached to a loader for repositioning or relocating the loader when detached from a work vehicle. Another technical effect of one or more of the example implementations disclosed herein is one or more roller apparatus fixedly, rotatably, movably, or removably attached to the loader. Another technical effect of one or more of the example implementations disclosed herein is a connector attached to the loader and providing a connection for another vehicle to reposition or relocate the loader when detached from a work vehicle. Another technical effect of one or more of the example implementations disclosed herein is the ability to move, reposition, or relocate a loader when detached from the work vehicle.

The terminology used herein is for describing particular implementations and is not intended to be limiting of the present disclosure. As used herein, the singular forms "a," "an," and "the" are intended to include the plural forms as well, unless the context clearly indicates otherwise. It will be further understood that any use of the terms "has," "includes," "comprises," or the like, in this specification, identifies the presence of stated features, integers, steps, operations, elements, and/or components, but does not preclude the presence or addition of one or more other features, integers, steps, operations, elements, components, and/or groups thereof. One or more of the steps or operations in any of the methods, processes, or systems discussed herein may be omitted, repeated, re-ordered, combined, or separated and are within the scope of the present disclosure.

As used herein, "e.g." is utilized to non-exhaustively list examples and carries the same meaning as alternative illustrative phrases such as "including," "including, but not limited to," and "including without limitation." Unless otherwise limited or modified, lists with elements that are separated by conjunctive terms (e.g., "and") and that are also preceded by the phrase "one or more of" or "at least one of" indicate configurations or arrangements that potentially include individual elements of the list, or any combination thereof. For example, "at least one of A, B, and C" or "one or more of A, B, and C" indicates the possibilities of only A, only B, only C, or any combination of two or more of A, B, and C (e.g., A and B; B and C; A and C; or A, B, and C).

While the above describes example implementations of the present disclosure, these descriptions should not be viewed in a restrictive or limiting sense. Rather, there are several variations and modifications which may be made without departing from the scope of the appended claims.

What is claimed is:

1. A loader for a work vehicle, comprising:
a loader arm;
a mast rotatably connected to the loader arm;
an implement removably attached to the loader arm;
a first actuator connected between the loader arm and the mast;
a second actuator connected between the loader arm and the implement; and
a first roller apparatus having a use position and a storage position, the first roller apparatus removably attached to the loader at a first attachment position near the implement in the use position, the first roller being detached from the first attachment position and removably attached to the loader at a different second attachment position spaced apart from the implement in the storage position, the first attachment position located closer to the implement than the second attachment position, the first roller apparatus positioned nearer a ground surface in the use position than in the storage position, and the first roller apparatus in contact with the ground surface in the use position and spaced apart from the ground surface in the storage position when the loader is in a lowered position.

2. The loader of claim 1, wherein the first roller apparatus is positioned on the loader arm in the storage position.

3. The loader of claim 1, wherein the first roller apparatus is positioned on the mast in the storage position.

4. The loader of claim 1, wherein the first roller apparatus includes a brake.

5. The loader of claim 1, further comprising:
a ground engaging lock.

6. The loader of claim 1, further comprising:
a parking stand having a storage condition and a parking condition.

7. The loader of claim 6, further comprising:
a second roller apparatus positioned on the parking stand, the second roller apparatus being in a use position when the parking stand is in the parking condition, and the second roller apparatus being in a storage position when the parking stand is in the storage condition.

8. The loader of claim 7, further comprising:
an attachment bracket mounted between the implement and the loader arm;
the first roller apparatus removable attached to the attachment bracket; and
the second roller apparatus fixedly attached to the parking stand.

9. The loader of claim 1, comprising:
a connector attached to a top portion of the implement, the connector including a use position and a storage position, the connector including a rigid member, a coupler, and one or more attachment portions.

10. The loader of claim 9, wherein the connector is removably attached to the top portion of the implement in the use position and removably attached to the loader arm in the storage position.

11. The loader of claim 9, wherein the connector is rotatably attached to the top portion of the implement in the use position and the storage position.

12. The loader of claim 1, further comprising:
a parking stand rotatably attached to the mast, the parking stand including a third roller apparatus and a fourth roller apparatus, and the parking stand having a storage condition and a parking condition.

13. A loader for a work vehicle, comprising:
a loader arm;
a mast rotatably connected to the loader arm;
an attachment bracket attached to the loader arm;
an implement removably attached to the attachment bracket;
a first actuator connected between the loader arm and the mast;
a second actuator connected between the loader arm and the implement;
a parking stand having a storage condition and a parking condition;
a first roller apparatus having a use position and a storage position, the first roller apparatus removably attached to the loader at a first attachment position near the implement in the use position, the first roller being detached from the first attachment position and removably attached to the loader at a different second attachment position spaced apart from the implement in the storage position, the first attachment position located closer to the implement than the second attachment position, the first roller apparatus positioned near the implement in a use position, the first roller apparatus positioned nearer a ground surface in the use position than in the storage position, and the first roller apparatus in contact with the ground surface in the use position and spaced apart from the ground surface in the storage position when the loader is in a lowered position; and
a second roller apparatus attached to the parking stand, the second roller in contact with the ground surface when the parking stand is in the parking condition, and the second roller spaced apart from the ground surface when the parking stand is in the storage condition.

14. The loader of claim 13, wherein the first roller apparatus includes a brake.

15. The loader of claim 13, further comprising:
a ground engaging lock.

16. The loader of claim 13, further comprising:
a connector attached to a top portion of the implement, the connector including a use position and a storage position, the connector including a rigid member, a coupler, and one or more attachment portions.

17. The loader of claim 16, wherein the connector is removably attached to the top portion of the implement in the use position and removably attached to the loader arm in the storage position.

18. The loader of claim 16, wherein the connector is rotatably attached to the top portion of the implement in the use position and the storage position.

19. The loader of claim 13, further comprising:

a parking stand rotatably attached to the mast, the parking stand including a third roller apparatus and a fourth roller apparatus, and the parking stand having a storage condition and a parking condition.

* * * * *